US010001718B2

(12) United States Patent
Maezawa

(10) Patent No.: US 10,001,718 B2
(45) Date of Patent: Jun. 19, 2018

(54) DEVELOPING DEVICE AND IMAGE FORMING APPARATUS PROVIDED WITH SAME

(71) Applicant: KYOCERA Document Solutions Inc., Osaka-shi (JP)

(72) Inventor: Nobuhiro Maezawa, Osaka (JP)

(73) Assignee: KYOCERA DOCUMENT SOLUTIONS INC., Osaka-shi, Osaka (JP)

( * ) Notice: Subject to any disclaimer, the term of this patent is extended or adjusted under 35 U.S.C. 154(b) by 0 days. days.

(21) Appl. No.: 15/628,919

(22) Filed: Jun. 21, 2017

(65) Prior Publication Data

US 2018/0017887 A1 Jan. 18, 2018

(30) Foreign Application Priority Data

Jul. 14, 2016 (JP) ..... 2016-139028

(51) Int. Cl.

| | |
|---|---|
| ***G03G 15/20*** | (2006.01) |
| ***G03G 15/02*** | (2006.01) |
| ***G03G 15/08*** | (2006.01) |
| ***G03G 15/16*** | (2006.01) |

(52) U.S. Cl.

CPC ..... *G03G 15/0233* (2013.01); *G03G 15/0887* (2013.01); *G03G 15/168* (2013.01); *G03G 15/1655* (2013.01); *G03G 15/1675* (2013.01); *G03G 15/2053* (2013.01)

(58) Field of Classification Search

CPC ..... G03G 15/0233; G03G 15/0887; G03G 15/1655; G03G 15/1675; G03G 15/168; G03G 15/2053

See application file for complete search history.

(56) References Cited

U.S. PATENT DOCUMENTS 8,958,724 B2 * 2/2015 Nakaue ..... G03G 15/0893 399/255
2013/0202329 A1 * 8/2013 Akedo ..... G03G 15/0893 399/258

FOREIGN PATENT DOCUMENTS

JP 2004-151340 5/2004

* cited by examiner

*Primary Examiner* — Hoang Ngo
(74) *Attorney, Agent, or Firm* — Gerald E. Hespos; Michael J. Porco; Matthew T. Hespos

(57) ABSTRACT

A developing device includes a housing, a developing roller, a developer conveyance path, a partition plate, a developer supply port and a developer conveying member. The developer conveying member rotates such that an outer peripheral part thereof moves from top to bottom in a first area between a second shaft portion and the partition plate and moves from bottom to top in a second area between the second shaft portion and the side wall. The developer supply port is obliquely open above the second area. The housing includes a first space formed above the second area of the first conveyance path and a second space formed up to a position higher than the partition plate above the first area of the first conveyance path. The ceiling plate includes a ceiling portion. The ceiling portion restricts a movement of replenishing developer in the first direction.

8 Claims, 27 Drawing Sheets

DEVELOPING DEVICE AND IMAGE FORMING APPARATUS PROVIDED WITH SAME

INCORPORATION BY REFERENCE

This application is based on Japanese Patent Application No. 2016-139028 filed with the Japan Patent Office on Jul. 14, 2016, the contents of which are hereby incorporated by reference.

BACKGROUND

The present disclosure relates to a developing device and an image forming apparatus provided with the same.

Conventionally, an image forming apparatus with a photoconductive drum, a developing device and a developer storage container is known as an image forming apparatus for forming a toner image on a sheet. The developing device has developer supplied from the developer storage container and supplies the developer to the photoconductive drum. Further, a technique is known by which a reservoir of the developer is formed in a developer conveyance path of the developing device and the developer flows into the developing device from the developer storage container according to the amount of the developer in the reservoir (volume supply method, leveling method).

In such a developing device, the developer storage container is attached from above. Thus, a developer discharge port of the developer storage container and a developer supply port of the developing device are both formed of openings open along a horizontal direction and arranged proximate to and opposite to each other. The developer discharged from the developer discharge port directly flows into the developer supply port.

On the other hand, to improve user operability in using an image forming apparatus, a developer storage container may be attached to a developing device along various attaching directions. Particularly, if a developer supply port is open in an inclined part of a ceiling plate of a developing device according to an attachment path of the developer storage container, a height to a developer conveyance path in the developing device differs between one and the other ends of the developer supply port.

SUMMARY

A developing device according to one aspect of the present disclosure includes a housing, a developing roller, a developer conveyance path, a partition plate, a developer supply port, a developer conveying member and a conveying ability suppressing portion. The housing includes a ceiling plate. The developing roller includes a first shaft portion, is supported rotatably on the housing with the first shaft portion as a rotary shaft, and supplies developer to an image carrier, on a surface of which an electrostatic latent image is to be formed. The developer conveyance path includes a first conveyance path, in which the developer is conveyed in a first conveying direction along an axial direction of the first shaft portion, and a second conveyance path, which is arranged between the developing roller and the first conveyance path and in which the developer is conveyed in a second conveying direction opposite to the first conveying direction, and has an upper part covered by the ceiling plate, and the developer is conveyed in a circulating manner therein. The partition plate is arranged in the housing and partitions between the first and second conveyance paths along the axial direction such that the first and second conveyance paths communicate at both end parts. The developer supply port is open in the ceiling plate above the first conveyance path and replenishing developer discharged from a predetermined developer storage container flows thereinto. The developer conveying member is arranged in the first conveyance path, includes a second shaft portion parallel to the first shaft portion and conveys the developer in the first conveying direction to pass below the developer supply port by being rotated with the second shaft portion as a rotary shaft. The conveying ability suppressing portion partially suppresses a conveying ability of the developer of the developer conveying member on a side downstream of the developer supply port in the first conveying direction and forms a reservoir of the developer in an area of the first conveyance path facing the developer supply port. The developer in the reservoir seals the developer supply port from below when the amount of the developer in the developer conveyance path increases, whereas a clearance is formed between the reservoir and the developer supply port, whereby the replenishing developer flows into the first conveyance path from the developer supply port, when the amount of the developer in the developer conveyance path decreases. The housing includes a side wall standing to face the partition plate and extend in the first direction and defining the first conveyance path on a side opposite to the partition plate. The developer conveying member rotates such that an outer peripheral part thereof moves from top to bottom in a first area between the second shaft portion and the partition plate and moves from bottom to top in a second area between the second shaft portion and the side wall. The developer supply port is obliquely open above the second area such that a second end edge extending in the first direction on the second shaft portion side is arranged at a higher position than a first end edge extending in the first direction on the side wall side. When viewed in a cross-section perpendicular to the second shaft and passing through the developer supply port, the housing includes a first space formed above the second area of the first conveyance path and allowing communication between the developer supply port and the first conveyance path in a vertical direction and a second space formed up to a position higher than the partition plate to communicate with the first conveyance path above the first area of the first conveyance path and communicating with the first space in a horizontal direction. The ceiling plate includes a ceiling portion defining an upper surface part of the second space. The ceiling portion is configured by end edges of a plurality of ribs arranged adjacent to each other. The ceiling portion is arranged above the second end edge and partially restricts a movement of the replenishing developer in the first direction by coming into contact with the replenishing developer flowing into the second space from the first space.

Further, an image forming apparatus according to another aspect of the present disclosure includes an image carrier, the above developing device, a developer storage container and a transfer unit. An electrostatic latent image is to be formed on a surface of the image carrier, and the image carrier carries a developer image. The developing device supplies the developer to the image carrier. The developer storage container stores the replenishing developer to be supplied to the developing device inside. The transfer unit transfers the developer image from the image carrier to a sheet.

BRIEF DESCRIPTION OF THE DRAWINGS

FIG. 4 B is a perspective view of the developer storage container according to the one embodiment of the present disclosure.

DETAILED DESCRIPTION

Figure 1:
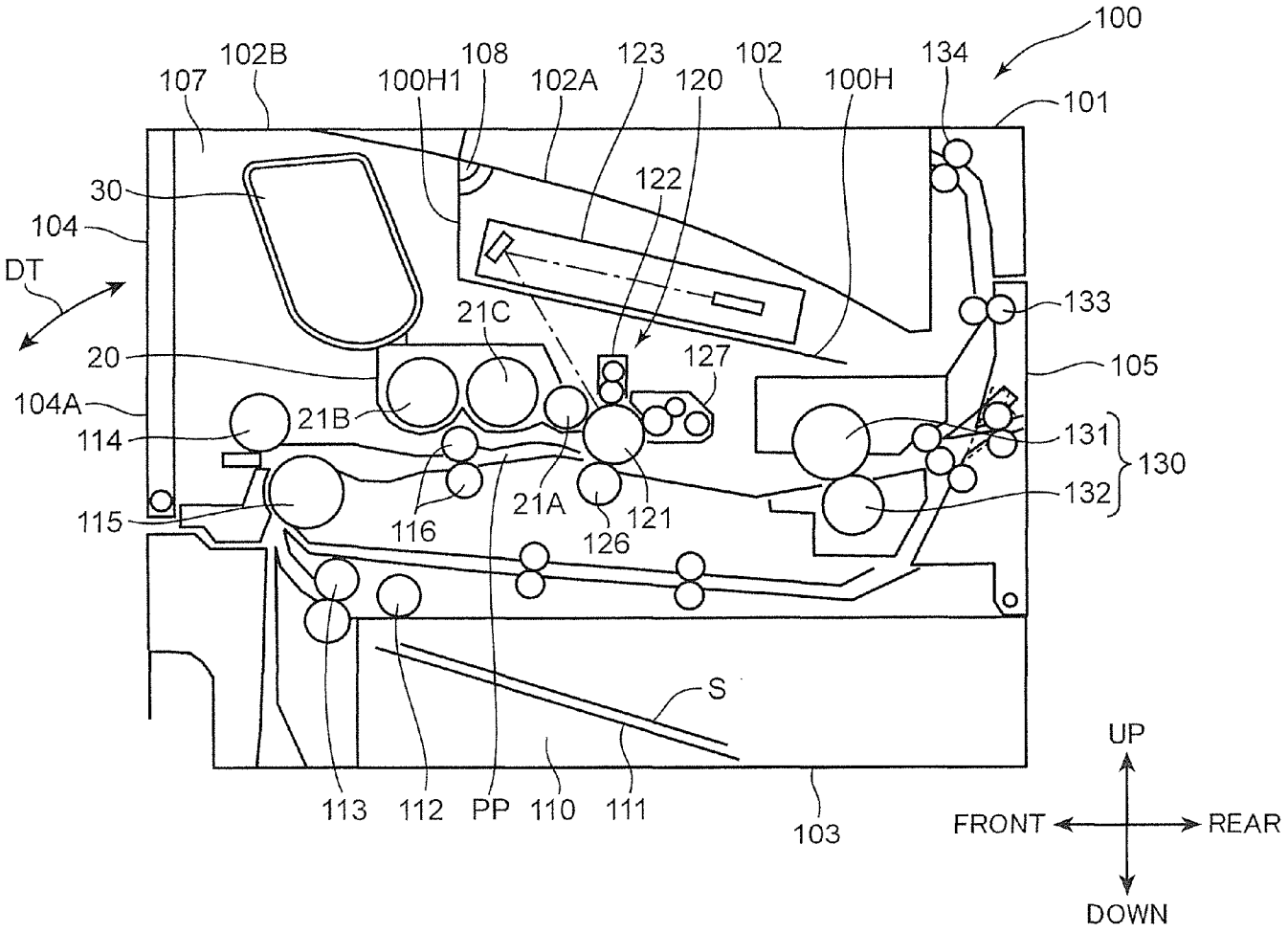
FIG. 1 is a sectional view showing an internal structure of an image forming apparatus according to one embodiment of the present disclosure.

Hereinafter, one embodiment of the present disclosure is described with reference to the drawings. FIG. 1 is a sectional view showing an internal structure of a printer 100 (image forming apparatus) according to the one embodiment of the present disclosure. The printer 100 as an image forming apparatus shown in FIG. 1 is a so-called monochrome printer. In other embodiments, the image forming apparatus may be a color printer, a facsimile machine, a complex machine provided with these functions or another apparatus for forming a toner image on a sheet. Note that direction-indicating terms such as "upper" and "lower", "front" and "back", "left" and "right" used in the following description are merely for the purpose of clarifying the description and do not limit the principle of the image forming apparatus at all.

The printer 100 includes a housing 101 for accommodating various devices for forming an image on a sheet S. The housing 101 includes an upper wall 102 defining the upper surface of the housing 101, a bottom wall 103 defining the bottom surface of the housing 101, a body rear wall 105 standing between the upper wall 102 and the bottom wall 103 and a body front wall 104 located in front of the body rear wall 105. The housing 101 has a body internal space 107 in which various devices are arranged. A sheet conveyance path PP along which a sheet S is conveyed in a predetermined conveying direction extends in the body internal space 107 of the housing 101.

A sheet discharge portion 102A is arranged in a central part of the upper wall 102. The sheet discharge portion 102A is formed of an inclined surface inclined downwardly from a front part to a rear part of the upper wall 102. A sheet S having an image formed thereon in an image forming unit 120 to be described later is discharged to the sheet discharge portion 102A. Further, a manual feed tray 104A is arranged at the body front wall 104. The manual feed tray 104A is vertically rotatable about a lower end (arrow DT of FIG. 1). If a front part 102B of the upper wall 102 is opened about a hinge 108 in addition to the manual feed tray 104A, a toner container 30 to be described later can be attached and detached.

With reference to FIG. 1, the printer 100 includes a cassette 110, a pickup roller 112, a first feed roller 113, a second feed roller 114, a conveyor roller 115, a pair of registration rollers 116, the image forming unit 120 and a fixing device 130.

The cassette 110 stores sheets S inside. The cassette 110 includes a lift plate 111. The lift plate 111 is inclined to push up the leading end edges of the sheets S. The cassette 110 can be pulled out forward with respect to the housing 101.

The pickup roller 112 is arranged above the leading end edges of the sheets S pushed up by the lift plate 111. When the pickup roller 112 rotates, the sheet S is pulled out from the cassette 110. The first feed roller 113 is arranged downstream of the pickup roller 112 and feeds the sheet S to a further downstream side. The second feed roller 114 is arranged inwardly (rearwardly) of a pivot point of the manual feed tray 104A and pulls a sheet S on the manual feed tray 104A into the housing 101.

The conveyor roller 115 is arranged downstream of the first feed roller 113 in a sheet conveying direction (hereinafter, also merely referred as to a conveying direction") of the second feed roller 114 and conveys the sheet S to a further downstream side. The pair of registration rollers 116 function to correct the oblique feed of the sheet S. In this way, the position of an image to be formed on the sheet S is adjusted. The pair of registration rollers 116 supply the sheet S to the image forming unit 120 in accordance with an image formation timing by the image forming unit 120.

The image forming unit 120 includes a photoconductive drum 121 (image carrier), a charger 122, an exposure device 123, a developing device 20, the toner container 30 (developer storage container), a transfer roller 126 (transfer unit) and a cleaning device 127.

The photoconductive drum 121 has a cylindrical shape. The photoconductive drum 121 has a surface, on which an electrostatic latent image is to be formed, and carries a toner image (developer image) corresponding to the electrostatic latent image on this surface. The charger 122 has a predetermined voltage applied thereto and substantially uniformly charges the peripheral surface of the photoconductive drum 121.

The exposure device 123 irradiates laser light to the peripheral surface of the photoconductive drum 121 charged by the charger 122. This laser light is irradiated in accordance with image data output from an external apparatus (not shown) such as a personal computer communicably connected to the printer 100. As a result, an electrostatic latent image corresponding to the image data is formed on the peripheral surface of the photoconductive drum 121. Note that, as shown in FIG. 1, the exposure device 123 is supported on a support frame 100H. The support frame 100H is a frame arranged inside the housing 101. The support frame 100H includes a frame front wall 100H1. The frame front wall 100H1 is a wall portion rising upwardly from a front end part of the support frame 100H.

The developing device 20 supplies toner to the peripheral surface of the photoconductive drum 121 having an electrostatic latent image formed thereon. The toner container 30 supplies the toner to the developing device 20. The toner container 30 is disposed to be detachably attachable to the developing device 20. When the developing device 20 supplies the toner to the photoconductive drum 121, the electrostatic latent image formed on the peripheral surface of the photoconductive drum 121 is developed (visualized). As a result, a toner image (developer image) is formed on the peripheral surface of the photoconductive drum 121.

A transfer nip portion is formed between the transfer roller 126 and the photoconductive drum 121, and the transfer roller 126 transfers the toner image to the sheet S. The cleaning device 127 removes the toner remaining on the peripheral surface of the photoconductive drum 121 after the toner image is transferred to the sheet S.

The fixing device 130 is arranged downstream of the image forming unit 120 in the conveying direction and fixes the toner image on the sheet S. The fixing device 130 includes a heating roller 131 for melting the toner on the sheet S and a pressure roller 132 for bringing the sheet S into close contact with the heating roller 131.

The printer 100 further includes a pair of conveyor rollers 133 arranged downstream of the fixing device 130 and a pair of discharge rollers 134 arranged downstream of the pair of conveyor rollers 133. The sheet S is conveyed upwardly by the pair of conveyor rollers 133 and finally discharged from the housing 101 by the pair of discharge rollers 134. The sheet S discharged from the housing 101 is stacked on the sheet discharge portion 102A.

<Concerning Developing Device>

Figure 2:
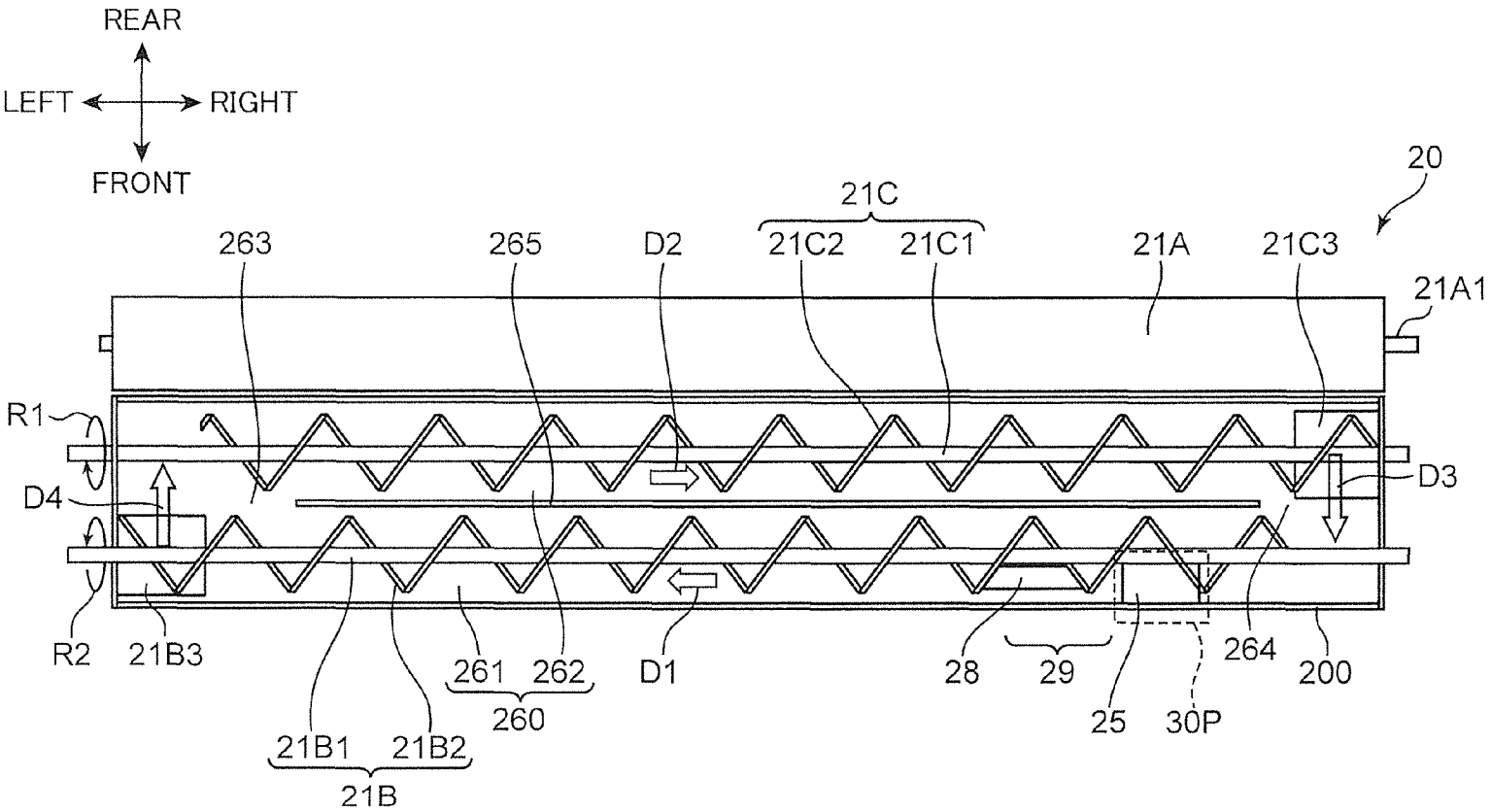
FIG. 2 is a plan view showing an internal structure of a developing device according to the one embodiment of the present disclosure.

FIG. 2 is a plan view showing an internal structure of the developing device 20. The developing device 20 includes a development housing 200 (housing) having a box shape long in one direction (axial direction of a developing roller 21A, lateral direction). This development housing 200 has a developer conveyance path 260. In this embodiment, a one-component development method is applied and the toner is filled as developer in this developer conveyance path 260. On the other hand, in the case of a two-component development method, the mixture of toner and carrier made of a magnetic material is filled as the developer. The toner is stirred and conveyed in the developer conveyance path 260 and successively supplied to the photoconductive drum 121 from the developing roller 21A to develop an electrostatic latent image. The development housing 200 includes a housing ceiling plate 200U to be described later (FIG. 6A).

Further, the developing device 20 includes the developing roller 21A, a first stirring screw 21B, a second stirring screw 21C and a partition plate 265.

The developing roller 21A has a cylindrical shape extending in a longitudinal direction of the development housing 200 and includes a sleeve part to be rotationally driven on an outer periphery. The developing roller 21A includes a roller shaft 21A1 (first shaft portion). The developing roller 21A is rotatably supported on the development housing 200 with the roller shaft 21A1 as a rotary shaft. The developing roller 21A supplies the toner (developer) to the photoconductive drum 121.

Figure 6A:
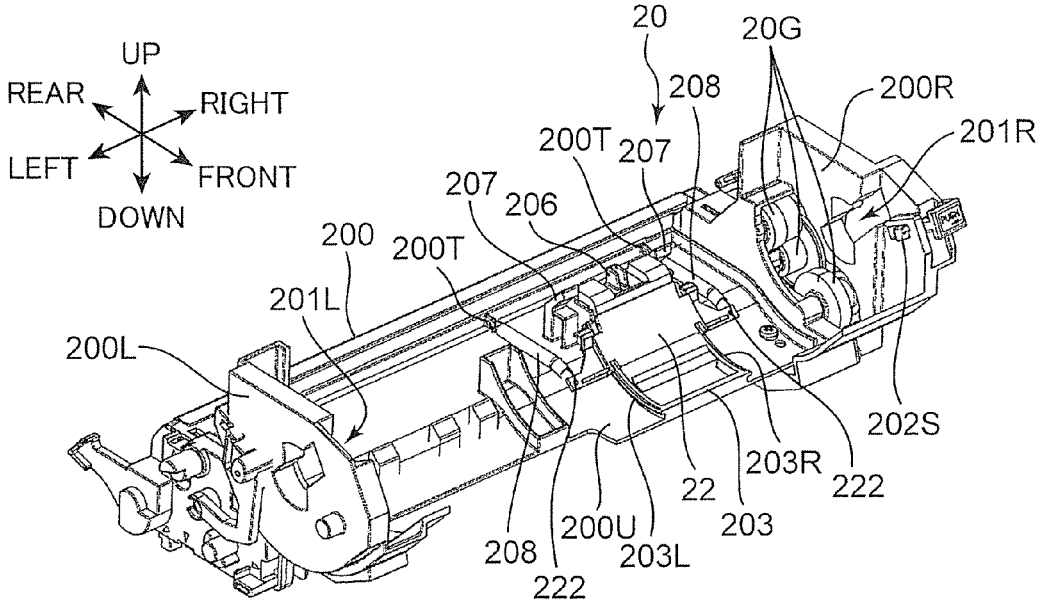
FIG. 6A is a perspective view of the developing device according to the one embodiment of the present disclosure.

The developer conveyance path 260 of the development housing 200 has an upper part covered by the housing ceiling plate 200U (FIG. 6A). The developer conveyance path 260 includes a first conveyance path 261 and a second conveyance path 262. In the first conveyance path 261, the toner is conveyed in a first conveying direction (arrow D1 of FIG. 2) along an axial direction of the roller shaft 21A1. The second conveyance path 262 is arranged between the developing roller 21A and the first conveyance path 261. In the second conveyance path 262, the toner is conveyed in a second conveying direction (arrow D2 of FIG. 2) opposite to the first conveying direction.

The partition plate 265 is arranged to extend in the lateral direction in the development housing 200. The partition plate 265 partitions between the first and second conveyance paths 261, 262 along the axial direction of the developing roller 21A such that the first and second conveyance paths 261, 262 communicate at both end parts. Thus, the partition plate 265 is set to be shorter than a lateral width of the development housing 200. In this way, a circulation path composed of the first conveyance path 261, a first communication path 263, the second conveyance path 262 and a second communication path 264 is formed in the developer conveyance path 260. The toner is conveyed clockwise in the circulation path in FIG. 2.

A toner supply port 25 (developer supply port) is an opening open in the housing ceiling plate 200U (FIG. 6A) of the development housing 200 and arranged above the vicinity of the right end of the first conveyance path 261. The toner supply port 25 is arranged to face the above circulation path and has a function of receiving (flowing) replenishing toner (replenishing developer) supplied from the toner container 30 into the developer conveyance path 260.

The first stirring screw 21B is disposed in the first conveyance path 261. The first stirring screw 21B includes a first screw shaft 21B1 (second shaft portion) and a first spiral blade 21B2 (spiral blade) spirally projecting on the periphery of the first screw shaft 21B1. The first screw shaft 21B1 extends in parallel to the roller shaft 21A1 of the developing roller 21A. The first stirring screw 21B is rotated (arrow R2) with the first screw shaft 21B1 as a rotary shaft to convey the toner in a direction of an arrow D1 of FIG. 2. The first stirring screw 21B conveys the developer to pass a position where the toner supply port 25 is facing the first conveyance path 261. In this way, the first stirring screw 21B has a function of conveying new toner flowing in from the toner supply port 25 and the toner conveyed to the first conveyance path 261 from the side of the second conveyance path 262 while mixing these. A first paddle 21B3 is disposed downstream of the first stirring screw 21B in the toner conveying direction (direction D1). The first paddle 21B3 is a plate-like member disposed on the first screw shaft 21B1. The first paddle 21B3 is rotated together with the first screw shaft 21B1 and transfers the toner from the first conveyance path 261 to the second conveyance path 262 in a direction of an arrow D4 of FIG. 2.

The second stirring screw 21C is disposed in the second conveyance path 262. The second stirring screw 21C includes a second screw shaft 21C1 and a second spiral blade 21C2 spirally projecting on the periphery of the second screw shaft 21C 1. The second stirring screw 21C is rotated (arrow R1) with the second screw shaft 21C1 as a rotary shaft, and supplies the toner to the developing roller 21A while conveying the toner in a direction of an arrow D2 of FIG. 2. A second paddle 21C3 is disposed downstream of the second stirring screw 21C in the toner conveying direction (direction D2). The second paddle 21C3 is rotated together with the second screw shaft 21C1 and transfers the toner from the second conveyance path 262 to the first conveyance path 261 in a direction of an arrow D3 of FIG. 2.

Figure 3:
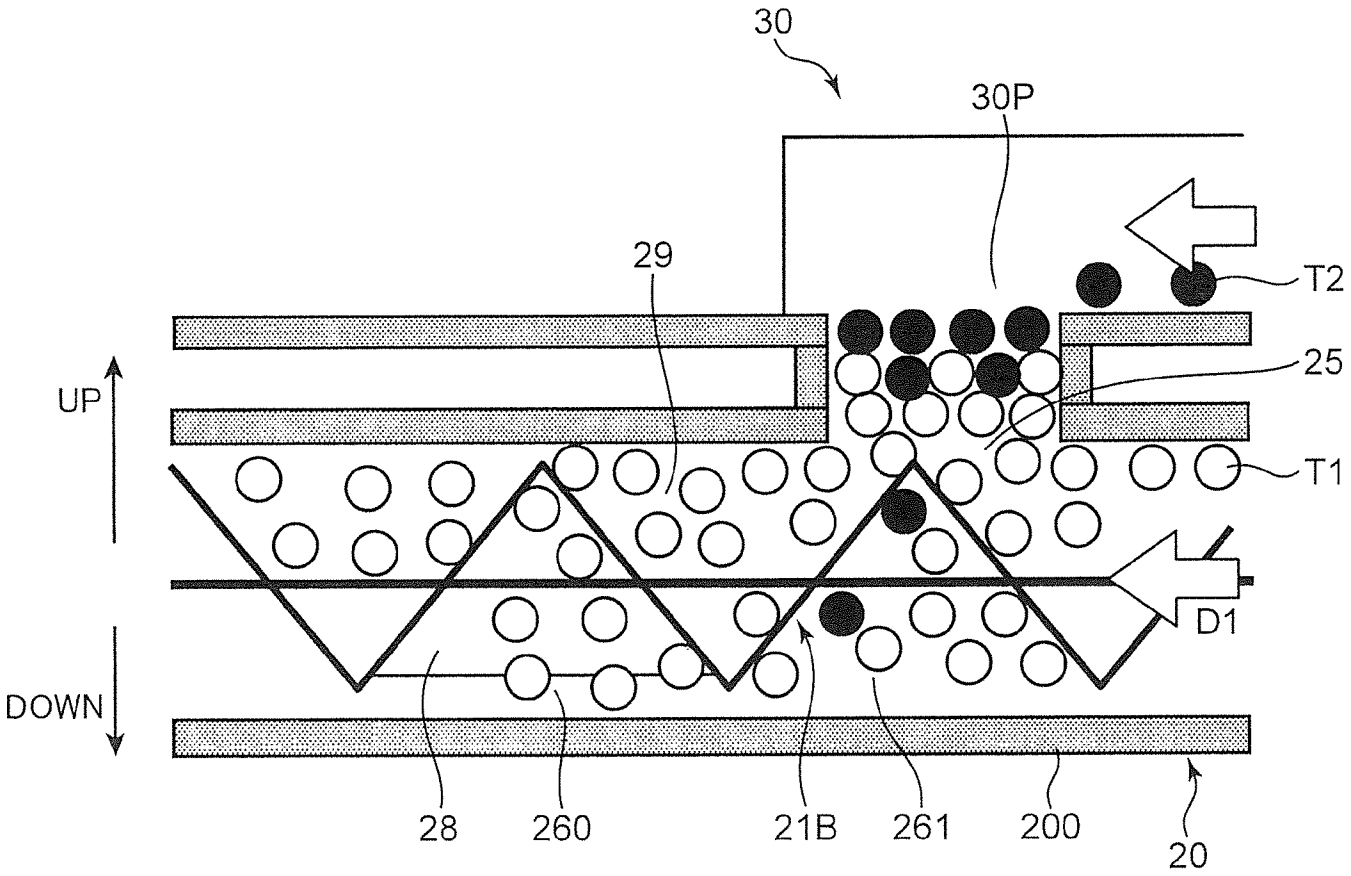
FIG. 3 is a schematic sectional view showing a state where developer is supplied to the developing device according to the one embodiment of the present disclosure.

The toner container 30 (FIGS. 1, 3) is arranged above the toner supply port 25 of the development housing 200. The toner container 30 includes a toner discharge port 30P (FIGS. 2, 3). The toner discharge port 30P is disposed in a bottom part of the toner container 30 to correspond to the toner supply port 25 of the developing device 20. The toner falling down from the toner discharge port 30P is supplied into the developing device 20 through the toner supply port 25.

<Concerning Toner Supply>

Next, the flow of the toner newly supplied from the toner supply port 25 is described in detail. FIG. 3 is a sectional view of the vicinity of the toner supply port 25 disposed in the developing device 20 and the toner discharge port 30P disposed in the toner container 30.

Replenishing toner particles T2 supplied from the toner discharge port 30P of the toner container 30 fall down into the first conveyance path 261, are mixed with existing toner particles T1 and conveyed in the direction of the arrow D1 by the first stirring screw 21B. At this time, the toner particles T1, T2 are stirred to be charged.

The first stirring screw 21B includes a suppressing paddle 28 (conveying ability suppressing portion) for partially suppressing a developer conveying ability on a side downstream of the toner supply port 25 in the toner conveying direction. In this embodiment, the suppressing paddle 28 is a plate-like member arranged between adjacent sections of the first spiral blade 21B2 of the first stirring screw 21B. By the rotation of the suppressing paddle 28 about the first screw shaft 21B1, the toner particles conveyed from a side upstream of the suppressing paddle 28 start being accumulated. These toner particles are accumulated up to a position which is immediately upstream of the suppressing paddle 28 and where the toner supply port 25 faces the first conveyance path 261. As a result, a reservoir 29 of the developer is formed near the entrance of the toner supply port 25.

When the replenishing toner particles T2 are supplied from the toner supply port 25 and the amount of toner particles (developer) in the developer conveyance path 260 increases, the toner particles accumulated in this reservoir 29 close (seal) the toner supply port 25 to suppress any further supply of the toner particles. Thereafter, when the toner particles in the developer conveyance path 260 are consumed by the developing roller 21A and the toner particles (developer amount) accumulated in the reservoir 29 decreases, the toner particles having closed the toner supply port 25 decrease to form a clearance between the reservoir 29 and the toner supply port 25. As a result, the replenishing toner particles T2 flow into the developer conveyance path 260 from the toner supply port 25 again. As just described, in this embodiment, a toner supply method of a volume supply type is employed by which the amount of the received replenishing toner particles is adjusted as the toner particles accumulated in the reservoir 29 decrease.

<Concerning Developer Storage Container and Developing Device>

Figure 4A:
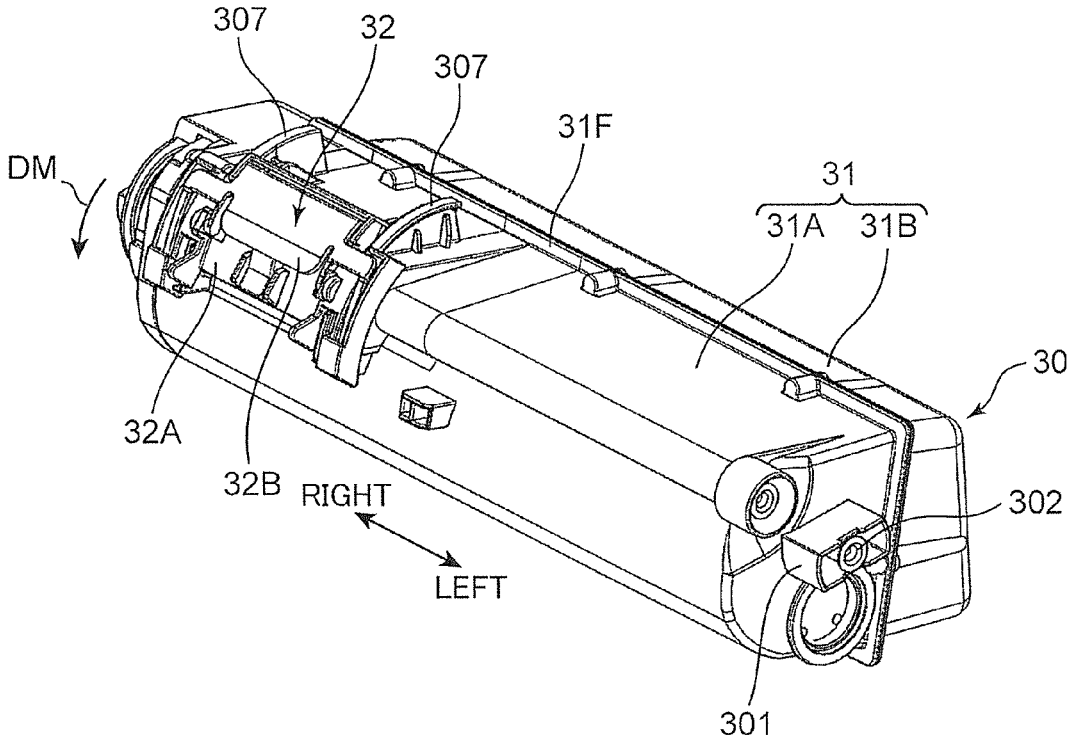
FIG. 4 A is a perspective view of a developer storage container according to the one embodiment of the present disclosure.
Figure 4B:
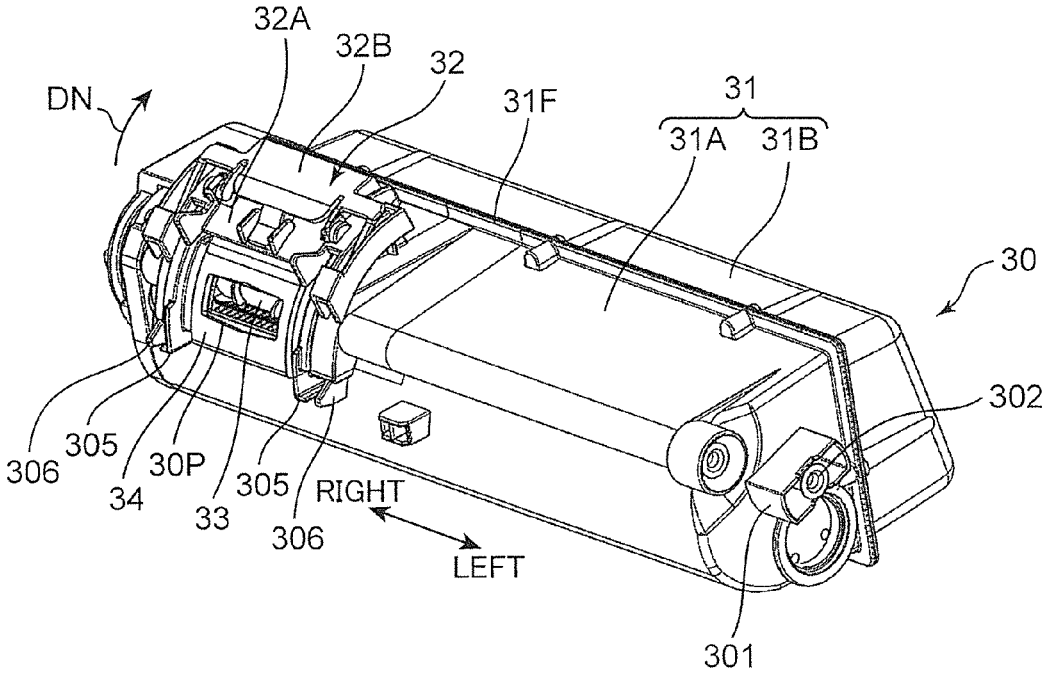
Figure 5A:
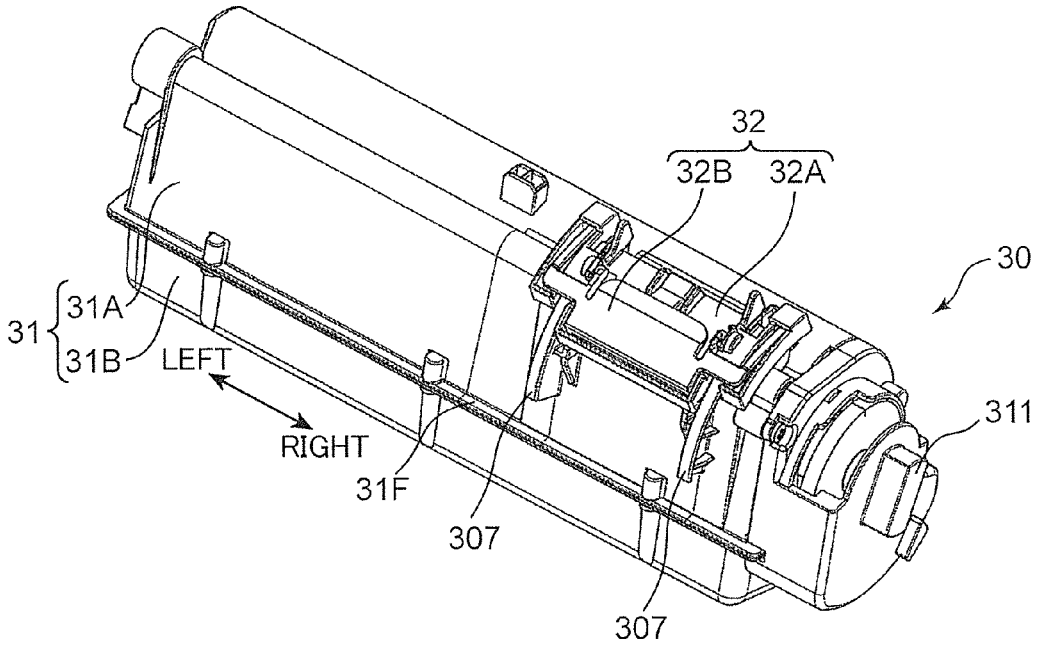
FIG. 5A is a perspective view of the developer storage container according to the one embodiment of the present disclosure.
Figure 5B:
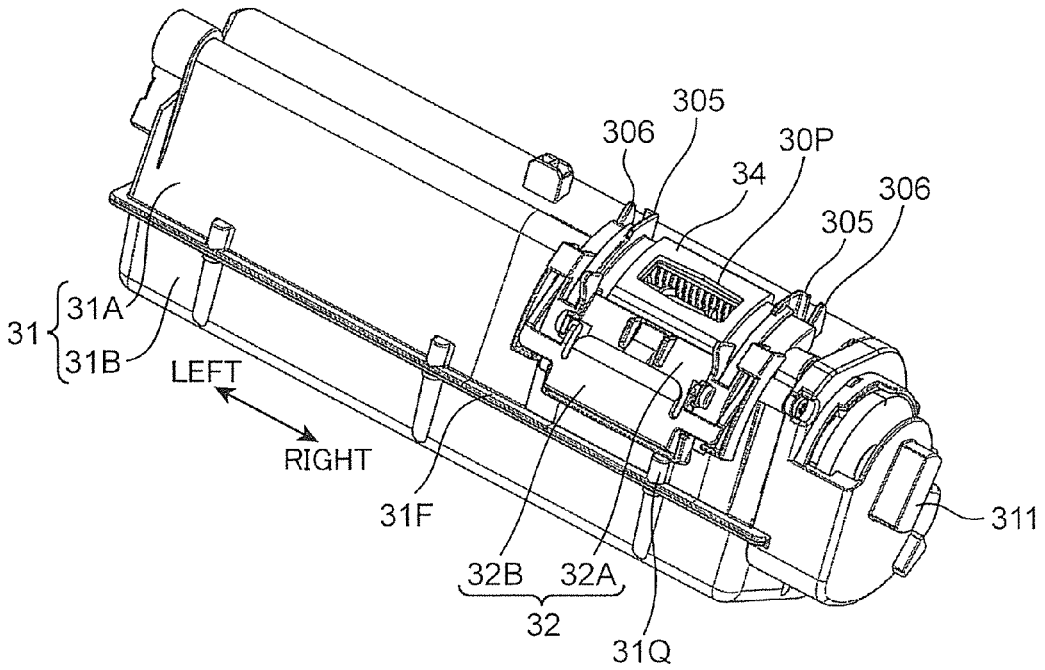
FIG. 5B is a perspective view of the developer storage container according to the one embodiment of the present disclosure.
Figure 6B:
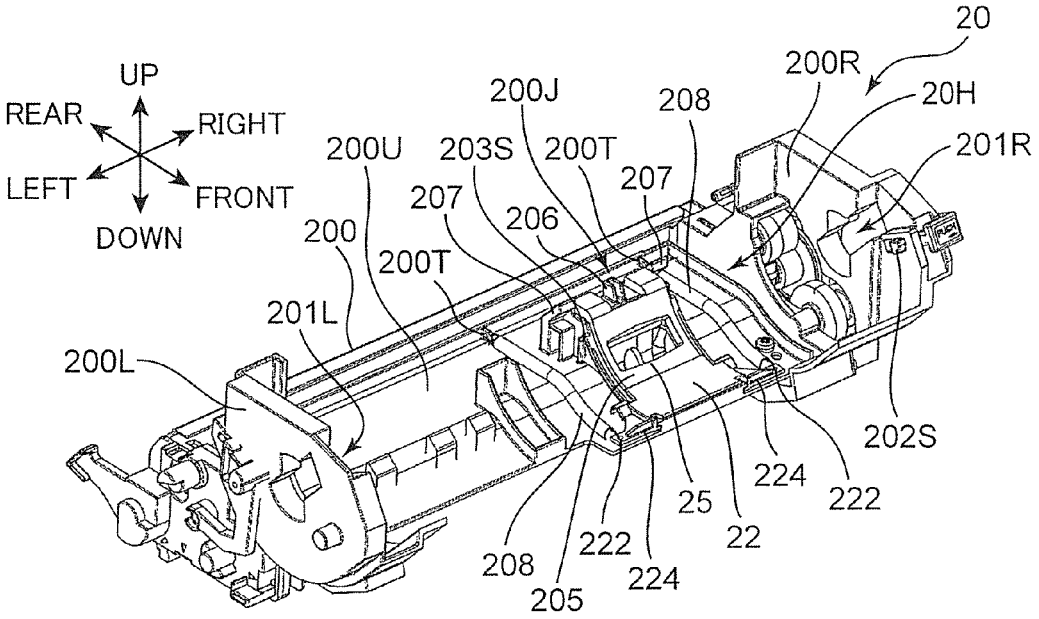
FIG. 6B is a perspective view of the developing device according to the one embodiment of the present disclosure.
Figure 7A:
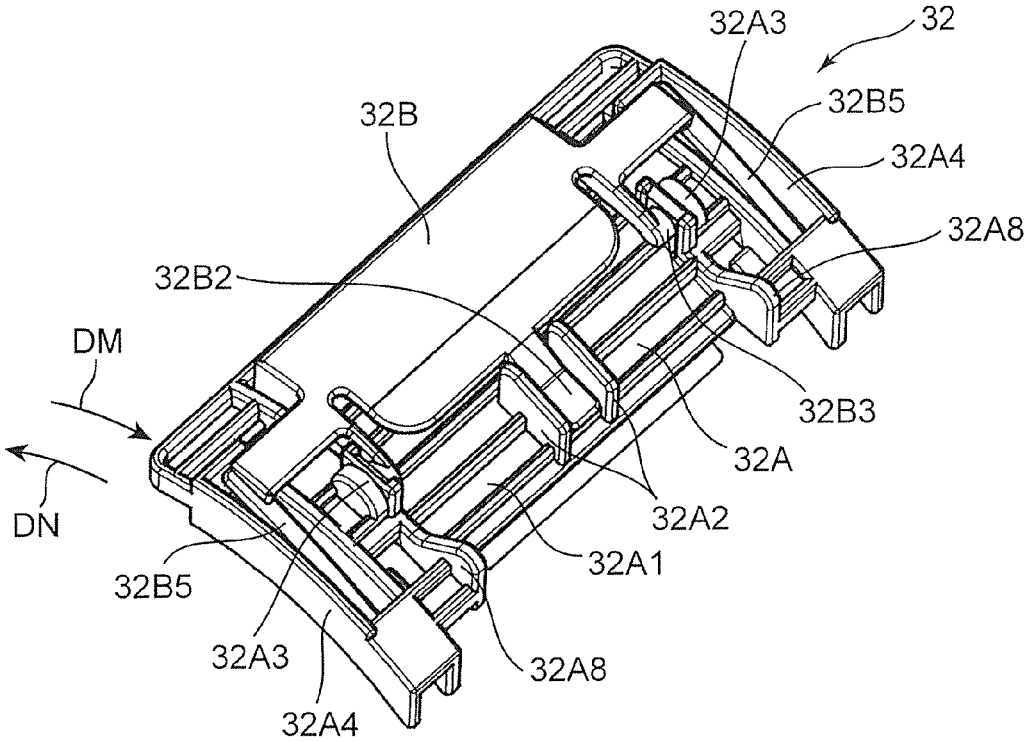
FIG. 7A is a perspective view of a shutter according to the one embodiment of the present disclosure.
Figure 7B:
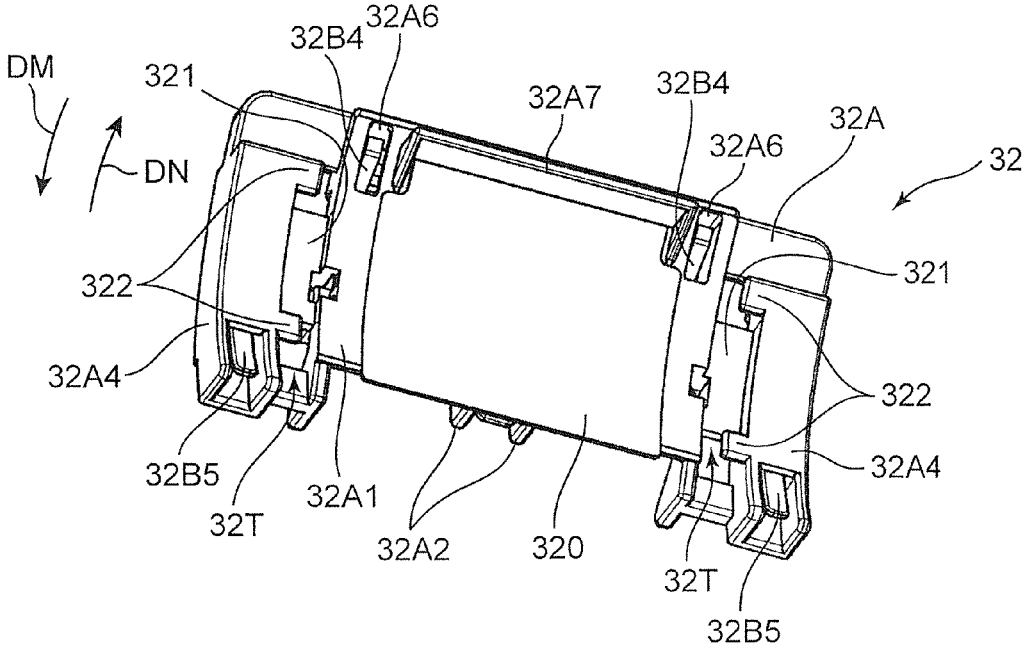
FIG. 7B is a perspective view of the shutter according to the one embodiment of the present disclosure.
Figure 8A:
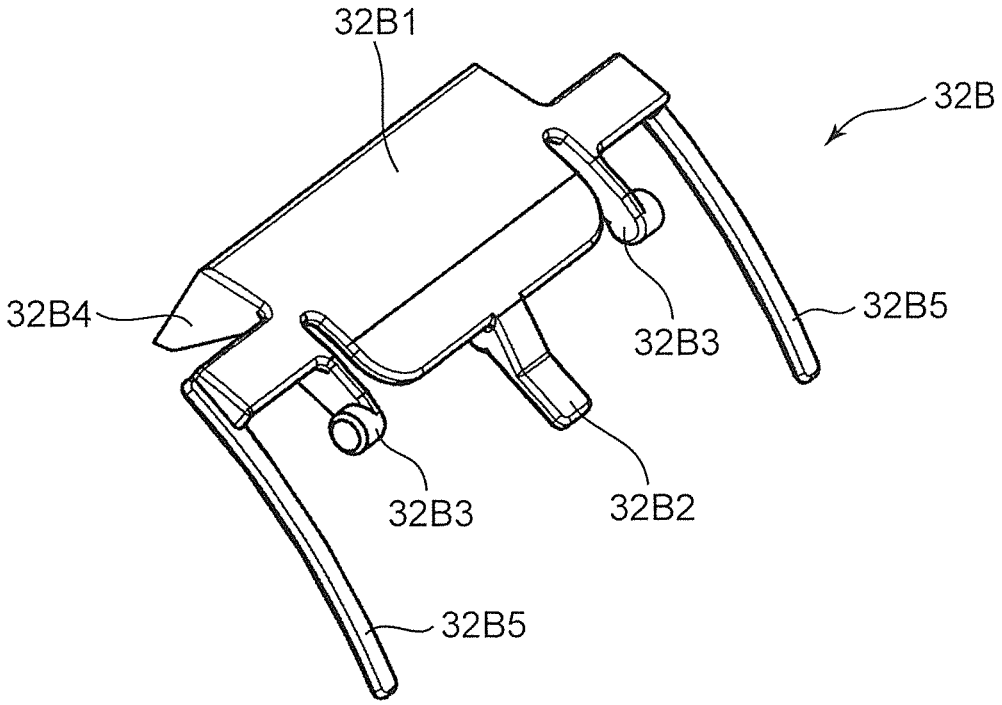
FIG. 8A is a perspective view of a part of the shutter according to the one embodiment of the present disclosure.
Figure 8B:
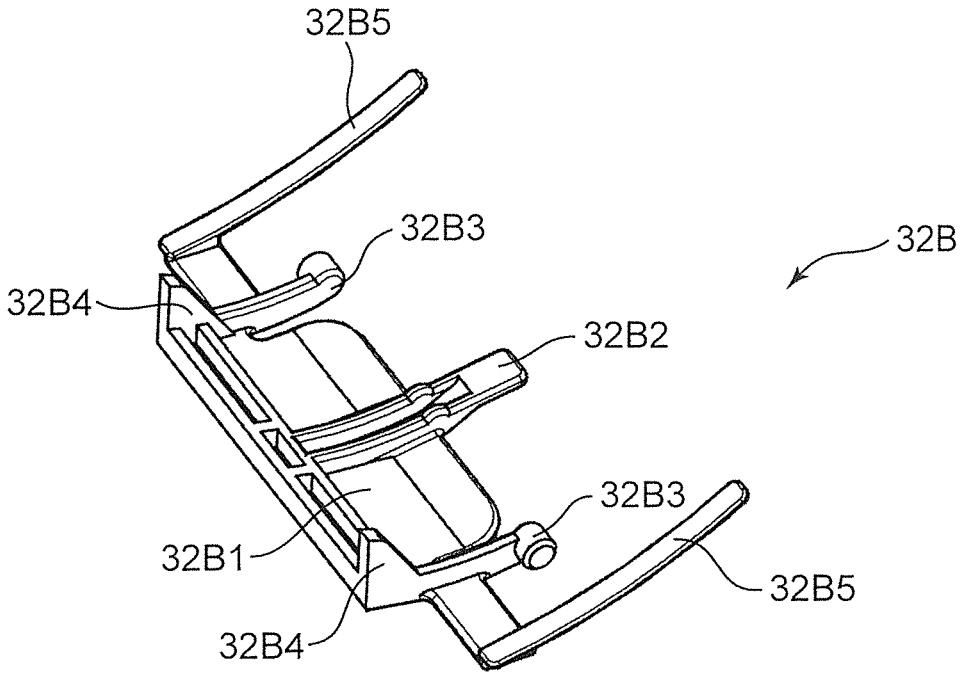
FIG. 8B is a perspective view of the part of the shutter according to the one embodiment of the present disclosure.
Figure 9A:
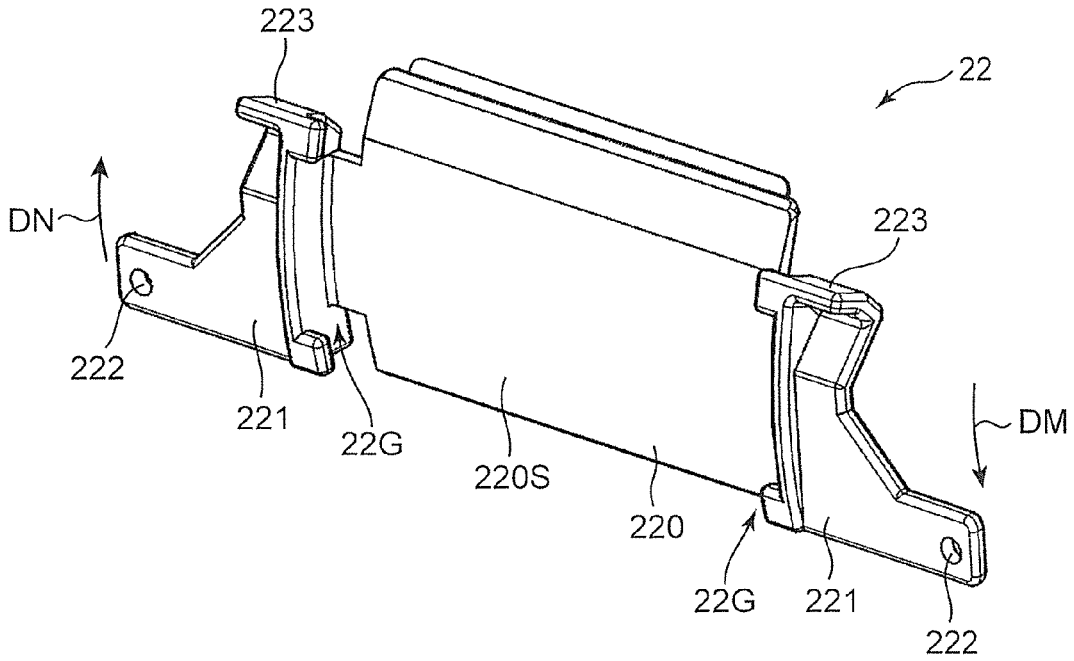
FIG. 9A is a perspective view of a body shutter according to the one embodiment of the present disclosure.
Figure 9B:
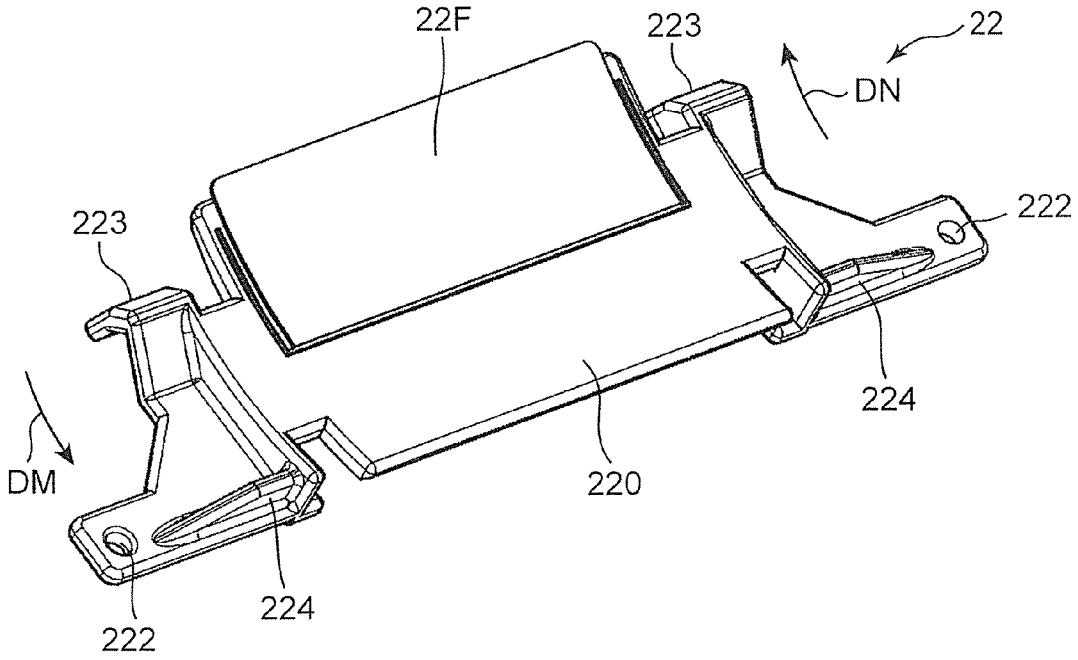
FIG. 9B is a perspective view of the body shutter according to the one embodiment of the present disclosure.
Figure 10:
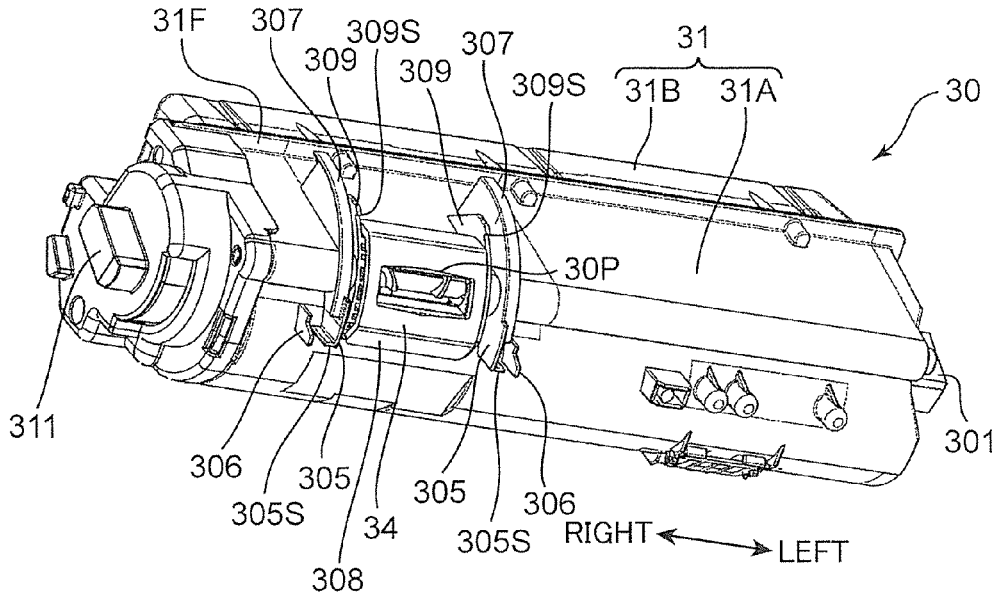
FIG. 10 is a perspective view showing a state where the shutter is removed from the developer storage container according to the one embodiment of the present disclosure.

Next, the toner container 30 and the developing device 20 according to this embodiment are described in more detail with reference to FIGS. 4A to 10. FIGS. 4A, 4B, 5A and 5B are perspective views of the toner container 30 according to this embodiment. Note that FIGS. 4A and 5A show a state where the toner discharge port 30P is closed by a container shutter 32 to be described later, and FIGS. 4B and 5B show a state where the toner discharge port 30P is open. Further, FIGS. 6A and 6B are perspective views of the developing device 20 according to this embodiment. Note that FIG. 6A shows a state where the toner supply port 25 is closed by a body shutter 22 and FIG. 6B shows a state where the toner supply port 25 is open. Further, FIGS. 7A and 7B are perspective views of the container shutter 32 to be mounted on the toner container 30. Note that FIG. 7A is equivalent to a view when the container shutter 32 is viewed from the outside of the toner container 30 and FIG. 7B is equivalent to a view when the container shutter 32 is viewed from the inside of the toner container 30. Further, FIGS. 8A and 8B are perspective views of a part (shutter stopper 32B) of the container shutter 32 according to this embodiment. Further, FIGS. 9A and 9B are perspective views of the body shutter 22 according to this embodiment. Note that FIG. 9A is equivalent to a view when the body shutter 22 is viewed from the inside of the developing device 20 and FIG. 9B is equivalent to a view when the body shutter 22 is viewed from the outside of the developing device 20. Furthermore, FIG. 10 is a perspective view showing a state where the container shutter 32 is removed from the toner container 30.

The toner container 30 stores the toner (replenishing developer) inside. The toner container 30 is shaped to be long in one direction. Note that, when being attached to the developing device 20 in the housing 101, the toner container 30 is arranged such that a longitudinal direction thereof is aligned with the lateral direction. However, this direction does not limit the present disclosure. The toner container 30 includes a container body 31, the container shutter 32 (shutter), a container screw 33 (FIG. 4B), a container paddle 30K (see FIG. 12K) and a container seal 34 (FIG. 4B).

Figure 12A:
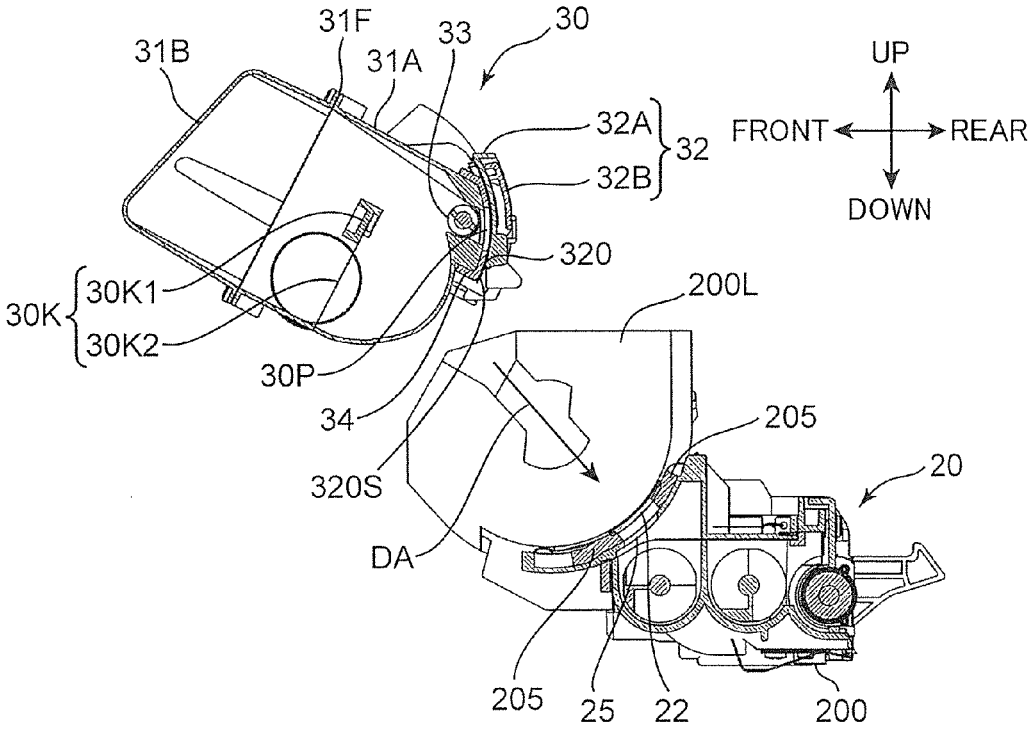
FIG. 12A is a sectional view showing the state of attaching the developer storage container to the developing device according to the one embodiment of the present disclosure.

The container body 31 is a body part of the toner container 30. The container body 31 includes a body portion 31A and a lid portion 31B. The body portion 31A is arranged in a lower part of the container body 31. The body portion 31A has such a shape obtained by partially cutting the peripheral surface of a tubular shape and includes an opening along the longitudinal direction of the toner container 30. The lid portion 31B is mounted in the opening of the body portion 31A and forms a storage space for storing the toner between the lid portion 31B and the body portion 31A. Note that, as shown in FIG. 12A, the body portion 31A has a substantially U shape and the lid portion 31B has a substantially trapezoidal shape in a cross-section intersecting with the longitudinal direction of the toner container 30. Further, as shown in FIGS. 4A to 5B, the toner container 30 includes container flanges 31F in a coupled part of the body portion 31A and the lid portion 31B. The container flange 31F is provided on each of the body portion 31A and the lid portion 31B and used to fix the lid portion 31B to the body portion 31A. After the body portion 31A of the toner container 30 is loaded with the container screw 33 and the like to be described later, the lid portion 31B is fused to the body portion 31A.

The toner container 30 further includes the aforementioned toner discharge port 30P (developer discharge port), a left guide 301 (FIG. 4A), a paddle bearing portion 302 (FIG. 4A), a pair of container shutter pressing portions 305 (FIG. 4B), a pair of elastic piece pressing portions (FIG. 4B), a pair of guide ribs 307 (FIG. 4A), a discharging projection 308 (see FIG. 10), a container shutter locking rib 309 (see FIG. 10) and a right guide 311 (FIG. 5A).

The toner discharge port 30P is an opening open on a right end side of the lower surface of the body portion 31A. Specifically, the toner discharge port 30P is a rectangular opening open in the peripheral surface of the discharging projection 308 (FIGS. 10, 12C) further projecting from a lower surface part of the body portion 31A while having an arcuate shape. The toner stored in the toner container 30 is discharged from the toner discharge port 30P and supplied to the developing device 20.

The left guide 301 is a projection formed to be long in a predetermined direction on the left side surface of the body portion 31A. The left guide 301 is engaged with a left guide groove 201L of the developing device 20 to be described later, and guided. As a result, an attaching direction of the toner container 30 to the developing device 20 (first direction, direction of an arrow DA of FIG. 11A) is restricted. Note that the inside of the left guide 301 is hollow. The paddle bearing portion 302 is a bearing portion arranged inside the left guide 301. The paddle bearing portion 302 rotatably supports a paddle shaft 30K1 (FIG. 12A) of the container paddle 30K.

The container shutter pressing portions 305 (FIGS. 4B, 5B, 10) are a pair of ribs projecting to sandwich the discharging projection 308 formed with the toner discharge port 30P in the longitudinal direction (lateral direction) of the toner container 30. The pair of container shutter pressing portions 305 respectively extend along a rotating direction of the toner container 30 and tip parts (container shutter pressing pieces 305S) are bent to extend along the longitudinal direction of the toner container 30 (respectively extend in the lateral direction).

The elastic piece pressing portions 306 (FIGS. 4B, 5B, 10) are a pair of projecting pieces adjacent to the container shutter pressing pieces 305S of the container shutter pressing portions 305 and projecting from the body portion 31A.

The guide ribs 307 (FIGS. 4A, 5A, 10) are a pair of arcuate rib members projecting from the body portion 31A and connected to the container shutter pressing portions 305. The guide ribs 307 support the container shutter 32 slidably about a predetermined axial center.

The container shutter locking ribs 309 (FIG. 10) are a pair of ribs extending along the rotating direction of the toner container 30 to be described later from left and right side edges of the discharging projection 308. More specifically, the pair of container shutter locking ribs 309 extend from the side edges of the discharging projection 308 in the rotating direction (second rotating direction, arrow DN of FIG. 4B) when the toner container 30 is detached from the developing device 20. Claw-like step portions (container shutter engaging portions 309S) are formed on the tips of the container shutter locking ribs 309 (FIG. 10). Stopper locking pieces 32B4 of the shutter stopper 32B to be described later are engageable with these container shutter engaging portions 309S.

The right guide 311 (FIG. 5A) is a projection formed on the right side surface of the body portion 31A. The right guide 311 projects to extend along the attaching direction (first direction, direction of the arrow DA of FIG. 11A) of the toner container 30 to the developing device 20. The right guide 311 is engageable with a right guide groove 201R of the developing device 20 to be described later. Note that a bearing portion similar to the paddle bearing portion 302 on the side of the left guide 301 is also arranged inside the right guide 311 and rotatably supports a shaft portion of the container paddle 30K.

The container shutter 32 (FIG. 4A) is supported on the container body 31 slidably with respect to the toner discharge port 30P and seals and opens the toner discharge port 30P. At this time, the container shutter 32 slides along the guide ribs 307 (FIG. 5A) of the container body 31. The container shutter 32 includes a shutter body 32A and the shutter stopper 32B. The shutter stopper 32B is mounted on the shutter body 32A.

With reference to FIGS. 7A and 7B, the shutter body 32A is a substantially rectangular member having a curved surface extending along the peripheral surface of the container body 31. The shutter body 32A includes a shutter plate portion 32A1, a pair of releasing piece supporting portions 32A2, a pair of stopper bearing portions 32A3, a pair of elastic piece supporting portions 32A4, a pair of shutter hole portions 32A6 (FIG. 7B), a shutter contact portion 32A7, a pair of shutter engaging pieces 32A8, a container shutter sheet 320, a pair of guided surfaces 321 and guided pieces 322.

The shutter plate portion 32A1 is a body part of the shutter body 32A and a substantially rectangular plate-like member. The pair of releasing piece supporting portions 32A2 are projecting pieces projecting from a central part of the shutter plate portion 32A1 in the longitudinal direction (lateral direction of FIG. 4A) as shown in FIG. 7A. A stopper releasing piece 32B2 of the shutter stopper 32B to be described later is arranged between the pair of releasing piece supporting portions 32A2. The pair of stopper bearing portions 32A3 are bearing portions arranged outwardly of the pair of releasing piece supporting portions 32A2 in the longitudinal direction. The pair of stopper bearing portions 32A3 rotatably support stopper pivot portions 32B3 to be described later. The pair of elastic piece supporting portions 32A4 are groove portions arranged outwardly of the pair of stopper bearing portions 32A3 in the longitudinal direction. Each elastic piece supporting portion 32A4 is formed by a bottom surface flush with the shutter plate portion 32A1 and a pair of side walls. A pair of elastic pieces 32B5 to be described later are accommodated inside the pair of elastic piece supporting portions 32A4.

With reference to FIG. 7B, the pair of shutter hole portions 32A6 are long and narrow hole portions open to penetrate through the shutter plate portion 32A1. Note that the pair of shutter hole portions 32A6 are open in a leading end part of the shutter plate portion 32A1 in the second rotating direction (direction of an arrow DN of FIG. 7B). The shutter contact portion 32A7 is a long and narrow projecting piece formed between the pair of shutter hole portions 32A6, and both end parts in the longitudinal direction are bent toward a downstream side in the first rotating direction (direction of an arrow DM of FIG. 7B). The shutter contact portion 32A7 has a function of restricting a movement of the container shutter 32 in the second rotating direction. The pair of shutter engaging pieces 32A8 are projecting pieces projecting between the shutter plate portion 32A1 and the pair of elastic piece supporting portions 32A4 in the longitudinal direction. The pair of shutter engaging pieces 32A8 have a substantially triangular shape. The pair of shutter engaging pieces 32A8 are engageable with a pair of container shutter fixing portions 207 of the developing device 20 to be described later.

The container shutter sheet 320 is a sheet member adhered to a surface for sealing the toner discharge port 30P, out of the shutter body 32A of the container shutter 32. In this embodiment, the container shutter sheet 320 is formed of a resin film member.

With reference to FIG. 7B, the guided surfaces 321 are surfaces arranged at positions lower than the elastic piece supporting portions 32A4 and the shutter plate portion 32A1 via steps between the shutter plate portion 32A1 and the elastic piece supporting portions 32A4. Further, a pair of guided pieces 322 are projections projecting from the bottom surfaces of the elastic piece supporting portions 32A4 on sides upstream and downstream of the guided surface 321 in the first rotating direction. A space portion extending along the first rotating direction is formed between the guided surface 321 and the guided pieces 322. One ends of the guide ribs 307 of the toner container 30 are inserted into these space portions through guide insertion openings 32T of FIG. 7B, whereby the container shutter 32 is mounted on the container body 31. As a result, the container shutter 32 is made slidable on the container body 31.

The shutter stopper 32B is mounted on a surface of the shutter body 32A opposite to the surface for sealing the toner discharge port 30P. The shutter stopper 32B has a function of restricting a sliding movement of the container shutter 32. With reference to FIGS. 8A and 8B, the shutter stopper 32B includes a stopper plate 32B1, a stopper releasing piece 32B2, a pair of stopper pivot portions 32B3, a pair of stopper locking pieces 32B4 and a pair of elastic pieces 32B5. The stopper plate 32B1 is a body part of the shutter stopper 32B and a plate-member having a substantially rectangular shape. The stopper releasing piece 32B2 is a projecting piece projecting from a central part of the stopper plate 32B1 in the longitudinal direction (lateral direction of FIG. 4A). Note that, as shown in FIG. 7A, the stopper releasing piece 32B2 projects toward a downstream side in the first rotating direction from the stopper plate 32B1. As described above, the stopper releasing piece 32B2 is arranged between the pair of releasing piece supporting portions 32A2 of the shutter body 32A. The pair of stopper pivot portions 32B3 are projecting pieces respectively projecting from the vicinities of end parts of the stopper plate 32B1 in the longitudinal direction and include slightly projecting shaft portions on tip parts thereof. These shaft portions of the stopper pivot portions 32B3 are inserted into the stopper bearing portions 32A3 of the shutter body 32A described above. As a result, the shutter stopper 32B is rotatable with respect to the shutter body 32A about an axis connecting the pair of stopper pivot portions 32B3.

The pair of stopper locking pieces 32B4 are projecting pieces projecting from both end parts of the stopper plate 32B1 in the longitudinal direction. As shown in FIGS. 8A and 8B, the stopper locking pieces 32B4 have a substantially triangular shape. The stopper locking pieces 32B4 are coupled to the stopper pivot portions 32B3 in the first rotating direction (FIG. 8B). The pair of elastic pieces 32B5 are long and narrow projecting pieces provided on both end parts of the shutter stopper 32B. Tip sides of the elastic pieces 32B5 are free ends extending in the first rotating direction.

When the pair of stopper pivot portions 32B3 are inserted into the pair of stopper bearing portions 32A3 to unite the shutter body 32A and the shutter stopper 32B, the pair of stopper locking pieces 32B4 are respectively inserted into the pair of shutter hole portions 32A6 (FIG. 7B). Further, the pair of elastic pieces 32B5 are accommodated into the pair of elastic piece supporting portions 32A4. At this time, tip parts of the elastic pieces 32B5 are exposed on the underside of the container shutter 32 as shown in FIG. 7B.

The container screw 33 (FIG. 4B) is a screw member arranged to extend in the lateral direction inside the container body 31. The container screw 33 conveys the toner in the container body 31 from left to right and further discharges the toner from the toner discharge port 30P.

The container paddle 30K (see FIG. 12A) is a paddle member rotatably arranged inside the container body 31. The container paddle 30K has a function of stirring the toner in the container body 31. The container paddle 30K includes a paddle shaft 30K1 and a paddle portion 30K2. The paddle shaft 30K1 serves as a shaft portion in the rotation of the container paddle 30K. The paddle shaft 30K1 is arranged to extend in the lateral direction in the container body 31 and rotatably supported on the paddle bearing portion 302 (FIG. 4B) described above. The paddle portion 30K2 is a plate-like member extending from the paddle shaft 30K1 and rotated inside the container body 31 with the paddle shaft 30K1 as an axial center.

The container seal 34 (FIGS. 4B, 5B) is an elastic seal arranged on the discharging projection 308 to surround the periphery of the toner discharge port 30P. In this embodiment, the container seal 34 is made of urethane sponge (elastic material). The container seal 34 prevents the leakage of the toner from the toner discharge port 30P in a closed state of the container shutter 32 by being compressed by the container shutter sheet 320 (FIG. 7B) of the container shutter 32.

Further, the development housing 200 includes a housing right wall 200R, a housing left wall 200L, the housing ceiling plate 200U, a left guide groove 201L, a right guide groove 201R, a body shutter guide portion 203, a body seal 205, a stopper pressing portion 206, a container shutter fixing portion 207 (shutter restricting portion), a shutter spring 208 and development gears 20G.

The housing right wall 200R is a side wall standing on a right end part of the development housing 200. Similarly, the housing left wall 200L is a side wall standing on a left end part of the development housing 200. A container attaching portion 20H is formed between the housing right wall 200R and the housing left wall 200L. The housing ceiling plate 200U is a ceiling plate of the development housing 200 and extends between the right wall 200R and the housing left wall 200L. A front end part of the housing ceiling plate 200U is formed by an arcuate surface extending along the outer peripheral surface of the toner container 30.

The left guide groove 201L and the right guide groove 201R are respectively groove portions formed in the housing left wall 200L and the housing right wall 200R. The left guide groove 201L and the right guide groove 201R guide the attachment of the toner container 30 to the container attaching portion 20H. Thus, entrance sides of the left and right guide grooves 201L, 201R are formed to extend along the attaching direction of the toner container 30 (first direction, direction of an arrow DA of FIG. 12A). On the other hand, back sides of the left and right guide grooves 201L, 201R have a fan shape to allow the rotation of the left and right guides 301, 311 as described later.

The body shutter guide portion 203 is formed by raising a part of the housing ceiling plate 200U to have a slight height. The body shutter guide portion 203 extends in a front-rear direction while having a predetermined width in the lateral direction. The body shutter guide portion 203 includes a left guide rail 203L and a right guide rail 203R. The left and right guide rails 203L, 203R are rails formed along left and right side edges of the body shutter guide portion 203. The left and right guide rails 203L, 203R have a function of guiding a sliding movement of the body shutter 22 to be described later.

The aforementioned toner supply port 25 is a substantially rectangular opening open in the body shutter guide portion 203. The toner supply port 25 communicates with the inside of the development housing 200. Further, the toner supply port 25 is arranged to face the toner container 30 attached to the container attaching portion 20H.

The body seal 205 (FIG. 6B) is an elastic seal arranged on the body shutter guide portion 203 to surround the periphery of the toner supply port 25. In this embodiment, the body seal 205 is made of urethane sponge (elastic material). The body seal 205 prevents the leakage of the toner (developer) from the toner supply port 25 in a closed state of the body shutter 22 by being compressed by the body shutter 22 (FIG. 6A) to be described later.

The stopper pressing portion 206 is a projection behind and adjacent to the toner supply port 25 and projecting from the housing ceiling plate 200U of the development housing 200. The stopper pressing portion 206 has a function of pressing the stopper releasing piece 32B2 of the container shutter 32 of the toner container 30 when the toner container 30 is attached to the container attaching portion 20H. In other words, the stopper pressing portion 206 allows a sliding movement of the toner discharge port 30P with respect to the container shutter 32.

The container shutter fixing portions 207 are projections projecting from the housing ceiling plate 200U to sandwich the stopper pressing portion 206 in the lateral direction. In a cross-section intersecting with the lateral direction, the container shutter fixing portion 207 has a substantially trapezoidal shape. Further, a wedge-shaped cutout is formed in a front side surface of the container shutter fixing portion 207. When the toner container 30 is attached to the container attaching portion 20H, the shutter engaging pieces 32A8 (FIG. 7A) of the container shutter 32 of the toner container 30 are engaged with these cutouts. As a result, the container shutter fixing portions 207 fix the container shutter 32 and restrict a movement of the container shutter 32.

The pair of shutter springs 208 are spring members arranged outwardly of the pair of container shutter fixing portions 207 in the lateral direction. The shutter springs 208 are arranged to extend in the front-rear direction. One end of the shutter spring 208 is locked to a body spring locking portion 200T (FIG. 6A) provided on the housing ceiling plate 200U. Further, the other end of the shutter spring 208 is locked to a shutter spring locking portion 222 (FIG. 6A) of the body shutter 22 to be described later.

The development gears 20G are a plurality of gears rotatably supported on the development housing 200 at an inner side of the housing right wall 200R. The development gears 20G transmit a rotational drive force to the developing roller 21A (FIG. 2), the first stirring screw 21B, the second stirring screw 21C, and the container screw 33 (FIG. 4B) and the container paddle 30K (FIG. 12A) of the toner container 30.

Further, the developing device 20 includes the body shutter 22. The body shutter 22 is supported on the development housing 200 slidably with respect to the toner supply port 25. The body shutter 22 seals or opens the toner supply port 25. With reference to FIGS. 9A and 9B, the body shutter 22 includes a body shutter plate 220, a pair of side pieces 221, a pair of shutter spring locking portions 222, a pair of body shutter pressing portions 223, a pair of shutter ribs 224 and a body sheet 22F.

The body shutter plate 220 is a body part of the body shutter 22 and a rectangular plate-like member having a predetermined curved surface. Note that a body sealing surface 220S of FIG. 9A is a surface for sealing the toner supply port 25. The pair of side pieces 221 are substantially triangular plate-like members connected to both side edges of the body shutter plate 220. The pair of shutter spring locking portions 222 are hole portions respectively open on tip parts of the pair of side pieces 221. As described above, the other end parts of the shutter springs 208 are locked to the shutter spring locking portions 222. The pair of body shutter pressing portions 223 are pressing surfaces respectively formed on the pair of side pieces 221. The body shutter pressing portions 223 are engageable with the container shutter pressing pieces 305S of the toner container 30. The body shutter pressing portions 223 have a function of pressing the container shutter pressing pieces 305S and a function of being pressed by the container shutter pressing pieces 305S. The pair of shutter ribs 224 are ribs standing on a side opposite to the body shutter pressing portions 223 in the side pieces 221. The rigidity of the side pieces 221 is maintained by the shutter ribs 224.

The aforementioned shutter springs 208 bias the body shutter 22 in such a direction that the body shutter 22 seals the toner supply port 25 (FIG. 6B). Thus, as shown in FIG. 6A, the body shutter 22 seals the toner supply port 25 by receiving biasing forces of the shutter springs 208 with the toner container 30 detached from the developing device 20. At this time, the body shutter pressing portions 223 of the body shutter 22 come into contact with body shutter restricting portions 203S (FIG. 6B) of the development housing 200, thereby restricting the position of the body shutter 22. Note that body shutter guide portions 22G of FIG. 9A, out of the body shutter 22, are guided by the arcuate left and right guide rails 203L, 203R (FIG. 6A). Thus, the shutter springs 208 bias the body shutter 22 along the second rotating direction (direction of an arrow DN of FIG. 9A). Note that the shutter springs 208 are slid about an axial center formed on the paddle shaft 30K1 (FIG. 12A) of the toner container 30 extending in the lateral direction.

Further, when the toner container 30 is attached to the container attaching portion 20H, the body shutter pressing portions 223 (FIG. 9B) of the body shutter 22 can press the container shutter pressing pieces 305S (FIG. 10) of the container shutter pressing portions 305. Thus, the shutter springs 208 bias the toner container 30 attached to the container attaching portion 20H in the second rotating direction about the axial center via the body shutter 22.

<Attachment of Developer Storage Container to Developing Device>

Figure 11A:
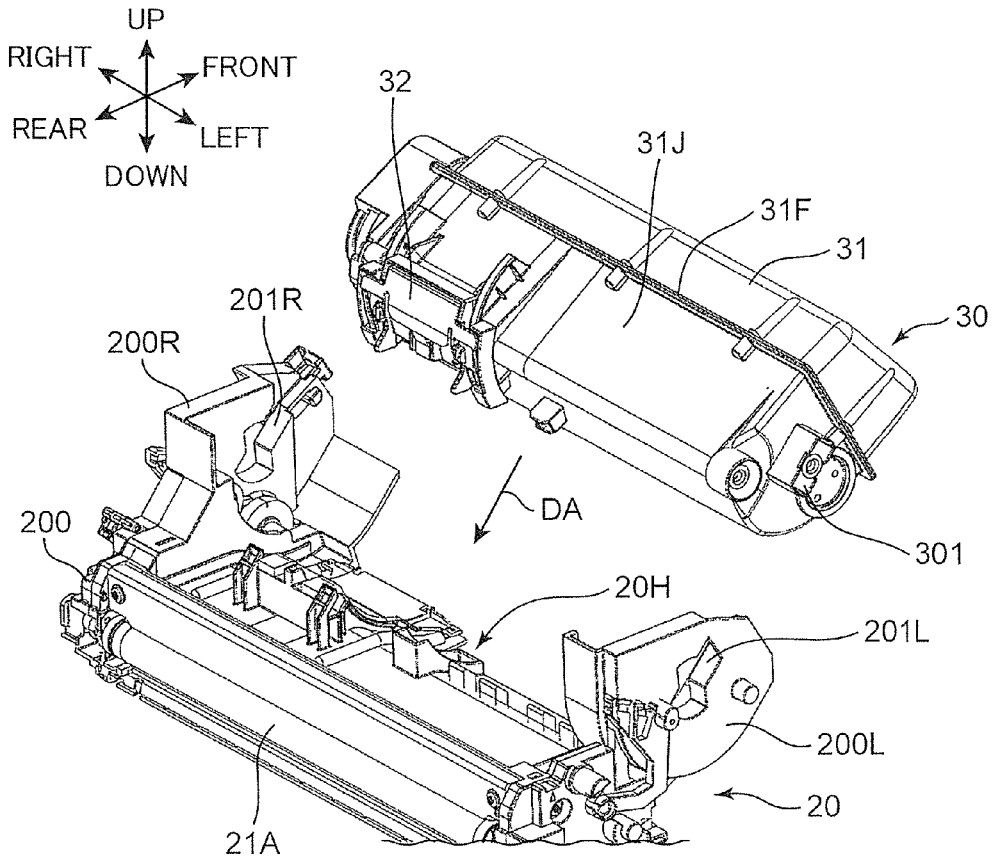
FIG. 11A is a perspective view showing a state of attaching the developer storage container to the developing device according to the one embodiment of the present disclosure.
Figure 11B:
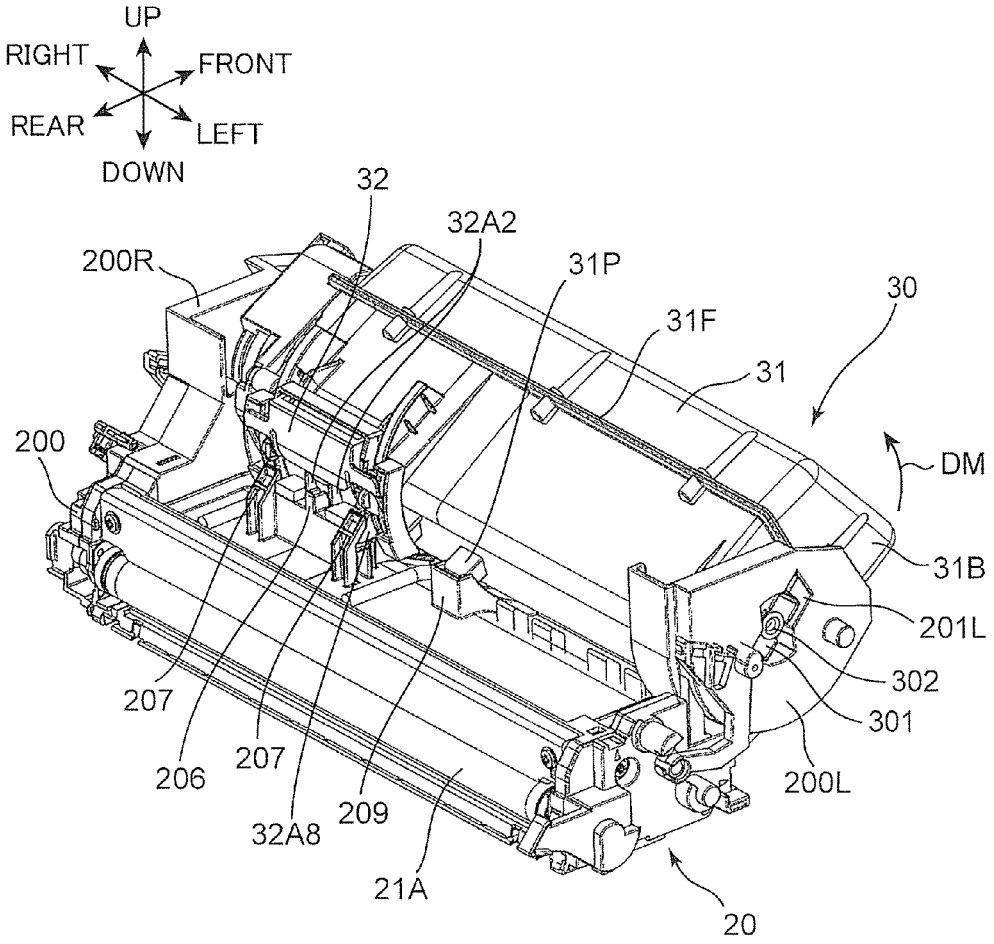
FIG. 11B is a perspective view showing the state of attaching the developer storage container to the developing device according to the one embodiment of the present disclosure.
Figure 11C:
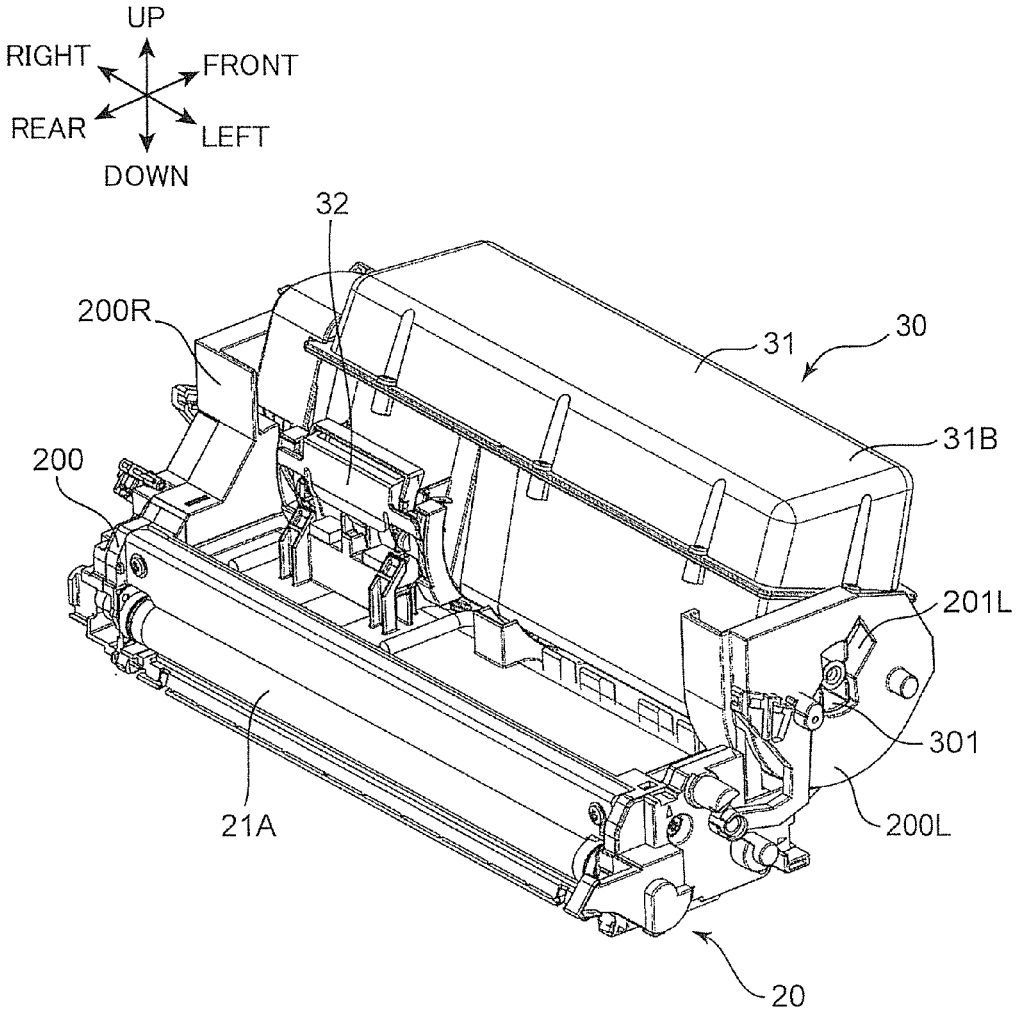
FIG. 11C is a perspective view showing the state of attaching the developer storage container to the developing device according to the one embodiment of the present disclosure.
Figure 12B:
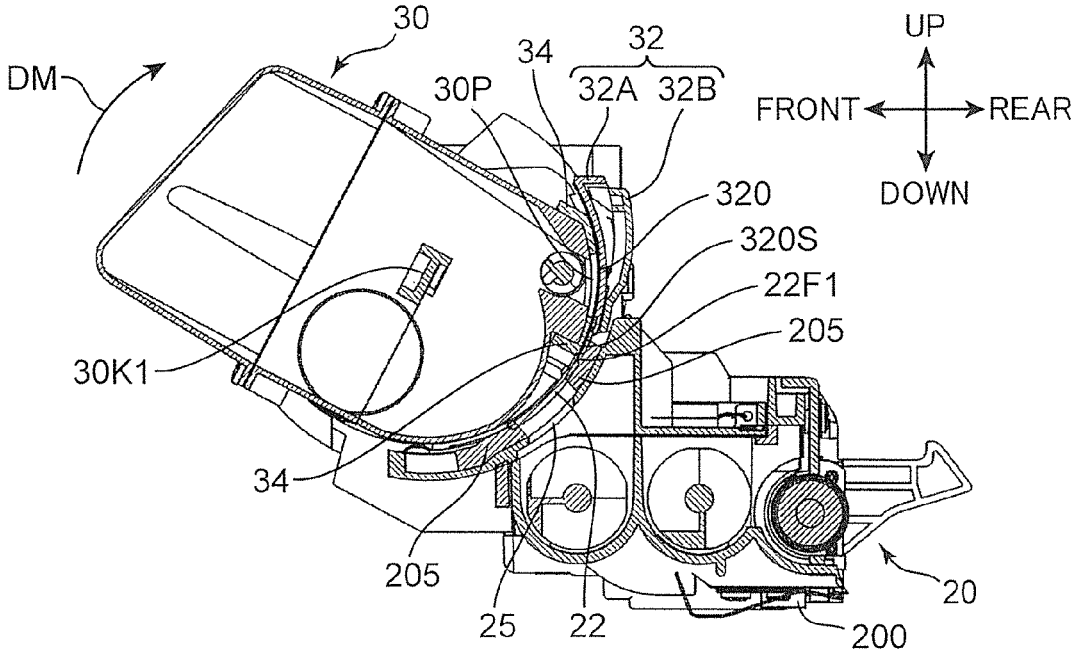
FIG. 12B is a sectional view showing the state of attaching the developer storage container to the developing device according to the one embodiment of the present disclosure.
Figure 12C:
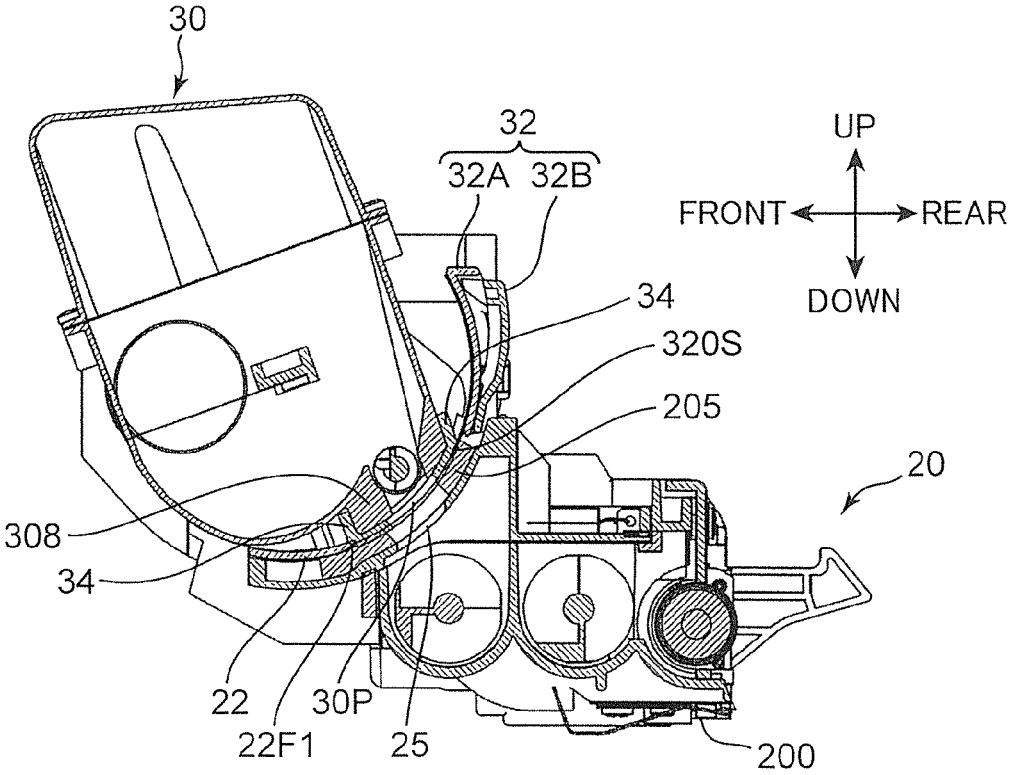
FIG. 12C is a sectional view showing the state of attaching the developer storage container to the developing device according to the one embodiment of the present disclosure.

Next, the attachment of the toner container 30 to the developing device 20 is described with reference to FIGS. 11A to 12C. FIGS. 11A to 11C are perspective views showing a state of attaching the toner container 30 to the developing device 20 according to this embodiment. Note that FIGS. 11A and 11B show a state while the toner container 30 is being attached and FIG. 11C shows a state where the toner container 30 is finally attached to the developing device 20. Further, FIGS. 12A to 12C are sectional views showing the state of attaching the toner container 30 to the developing device 20. Note that FIGS. 12A and 12B show the state while the toner container 30 is being attached and FIG. 12C shows the state where the toner container 30 is finally attached to the developing device 20.

Until the toner container 30 is attached to the developing device 20, the toner leaks out from the toner discharge port 30P if the container shutter 32 is erroneously moved from the position for sealing the toner discharge port 30P. In this embodiment, in a single state of the toner container 30, the container shutter 32 is prevented from sliding from the toner discharge port 30P. Specifically, as shown in FIGS. 4A and 5A, the stopper locking pieces 32B4 (FIG. 7B) penetrating through the shutter hole portions 32A6 are engaged with the container shutter engaging portions 309S of the container shutter locking ribs 309 on the side of the container body 31 in a state where the container shutter 32 closes the toner discharge port 30P. The tip parts of the elastic pieces 32B5 (FIG. 7B) exposed on the underside of the container shutter 32 through the elastic piece supporting portions 32A4 are biased radially outwardly of the toner container 30 by the elastic piece pressing portions 306 (FIG. 10). By biasing the tip parts of the elastic pieces 32B5 in this way, a moment is applied in a direction to strongly engage the stopper locking pieces 32B4 with the container shutter engaging portions 309S (FIG. 10) with the pair of stopper pivot portions 32B3 as pivot points in the shutter stopper 32B (FIG. 8A). Thus, when the toner container 30 is stored or transported in a single state, a sliding movement of the container shutter 32 along the guide ribs 307 is prevented. As a result, the toner discharge port 30P is stably sealed by the container shutter 32 (FIG. 7B).

With reference to FIGS. 11A and 12A, the toner container 30 is attached to the developing device 20 by a user of the printer 100. At this time, the user hooks the index and middle fingers on parts of the container flanges 31F located on an upper side of the toner container 30 of FIG. 12 and hooking the thumb on parts of the container flanges 31F located on a lower side of the toner container 30, thereby being able to easily grip the toner container 30. The user inserts the left and right guides 301, 311 of the toner container 30 into the left and right guide grooves 201L, 201R, whereby the toner container 30 is attached at a first position of the container attaching portion 20H (FIGS. 11B and 12B) while being guided along the attaching direction (direction of the arrow DA of FIGS. 11A and 12A) by the left and right guide grooves 201L, 201R. Note that the posture of the toner container 30 shown in FIGS. 11B and 12B is defined as a first posture.

At this time, as shown in FIG. 11B, the stopper pressing portion 206 of the development housing 200 presses the stopper releasing piece 32B2 (FIGS. 7A, 8A) arranged between the pair of releasing piece supporting portions 32A2. As a result, the shutter stopper 32B rotates about the pair of stopper pivot portions 32B3 and the pair of stopper locking pieces 32B4 are respectively disengaged from the container shutter engaging portions 309S (FIG. 10). As a result, the locking of the container shutter 32 by the shutter stopper 32B is released and the container shutter 32 is enabled to slide.

On the other hand, when the toner container 30 is attached in the first posture to the container attaching portion 20H, the pair of shutter engaging portions 32A8 (FIGS. 7A, 11B) of the container shutter 32 are engaged with the wedge-shaped cutouts of the container shutter fixing portions 207. As a result, the container shutter 32 is fixed to the container shutter fixing portions 207. Thereafter, the container body 31 of the toner container 30 is rotated from the first position in the first rotating direction (direction of the arrow DM of FIGS. 11B and 12B) about the axial center extending along the lateral direction intersecting with the attaching direction by the user. At this time, the toner discharge port 30P is separated from the container shutter 32 and the container body 31 reaches a second position while sliding. At this second position, the opened toner discharge port 30P communicates with the toner supply port 25 of the developing device 20 (FIGS. 11C, 12C). Note that the posture of the toner container 30 shown in FIGS. 11C and 12C is defined as a second posture. As just described, the user can attach the toner container 30 to the developing device 20 and open the toner discharge port 30P by two successive operations.

Further, in a state where the toner container 30 is not attached to the container attaching portion 20H, the body shutter 22 seals the toner supply port 25. As shown in FIGS. 11B and 12B, when the toner container 30 is attached in the first posture to the container attaching portion 20H, the container shutter pressing pieces 305S (FIG. 10) of the toner container 30 are arranged to face the body shutter pressing portions 223 of the body shutter 22. When the toner container 30 is rotated in the first rotating direction as described above to change the posture from the first posture to the second posture, the container shutter pressing pieces 305S press the body shutter pressing portions 223 in the first rotating direction against the biasing forces of the shutter springs 208 (FIG. 6A). As a result, the body shutter 22 slides in the first rotating direction together with the container body 31 of the toner container 30, whereby the toner supply port 25 is opened as shown in FIG. 6B. Thus, the toner discharge port 30P and the toner supply port 25 can communicate in the vertical direction (FIG. 12C).

In detaching the toner container 30 from the printer 100 (developing device 20), the toner container 30 is separated after being rotated in a procedure opposite to the one described above.

Figure 13:
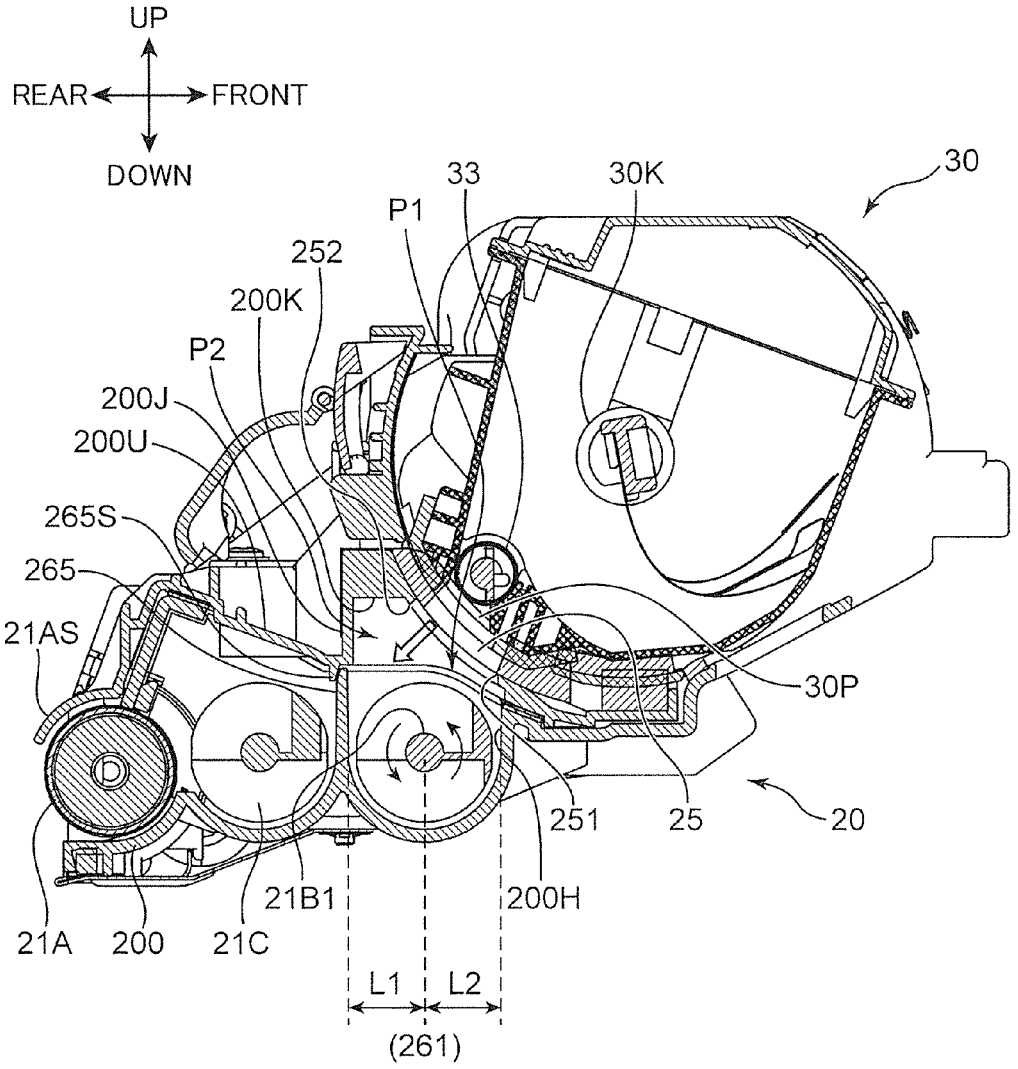
FIG. 13 is a sectional view of the developing device and the developer storage container according to the one embodiment of the present disclosure.
Figure 14A:
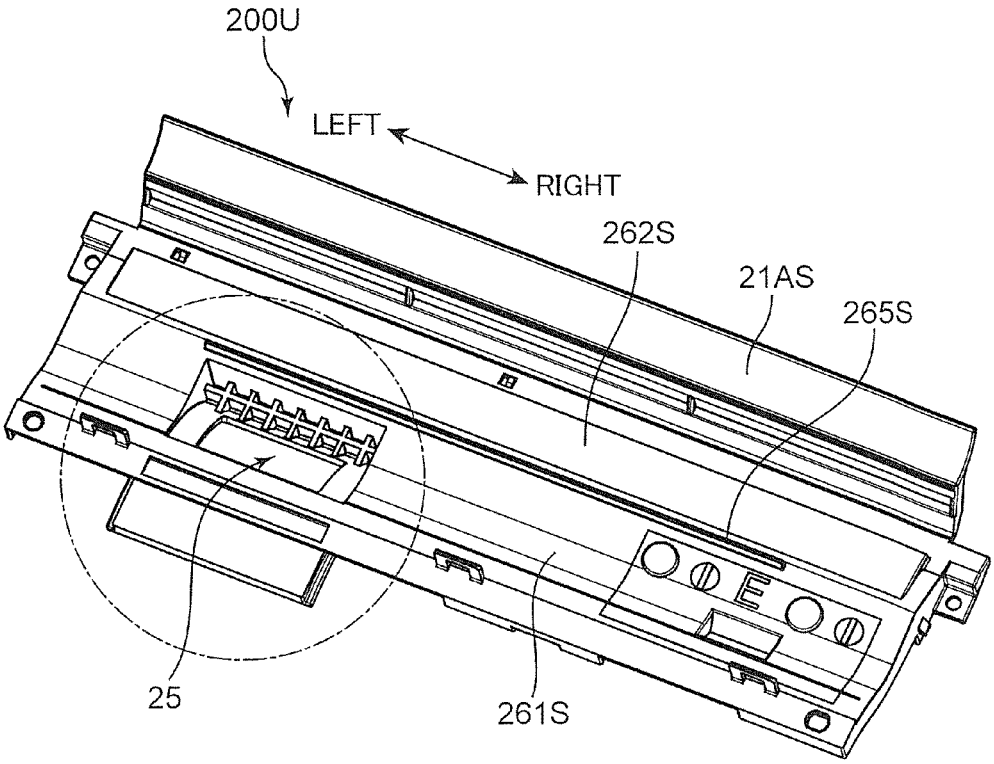
FIG. 14A is a perspective view of a ceiling plate of a housing of the developing device according to the one embodiment of the present disclosure.
Figure 14B:
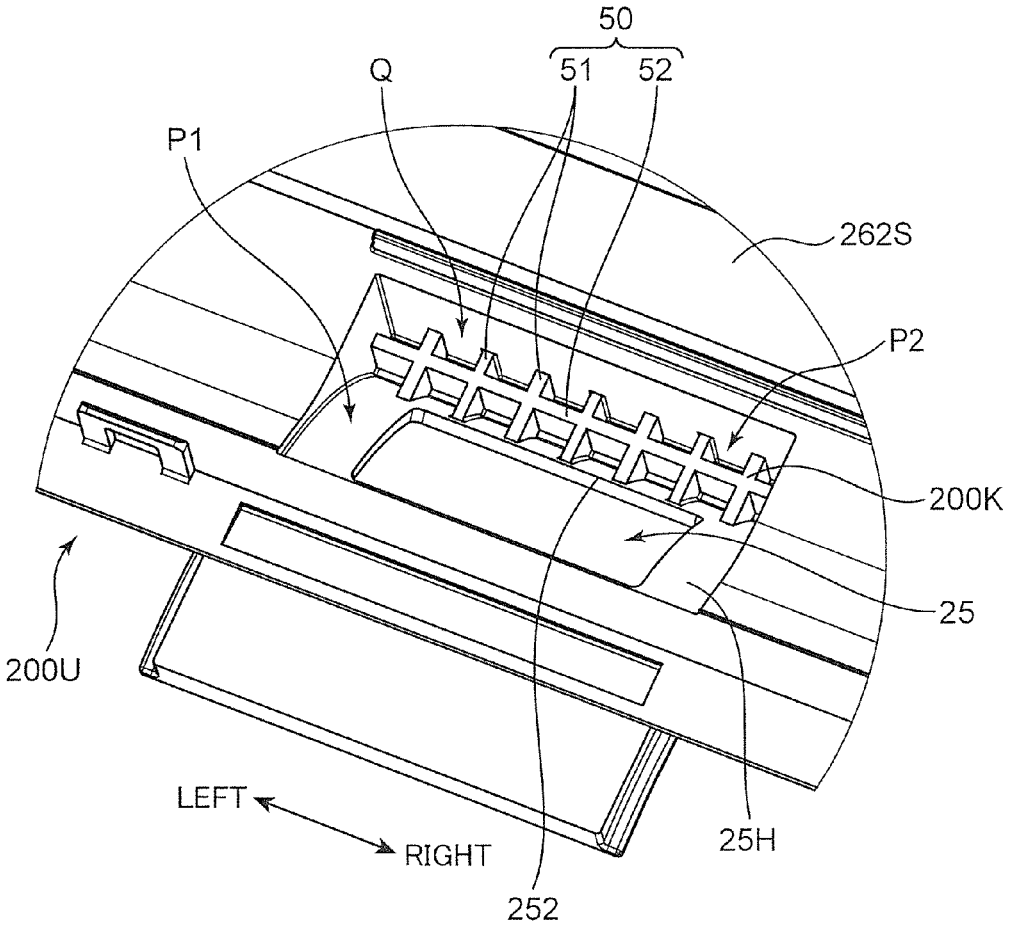
FIG. 14B is an enlarged perspective view enlargedly showing a part of the ceiling plate of FIG. 14A.

FIG. 13 is a sectional view of the developing device 20 and the toner container 30 according to this embodiment. FIG. 14A is a perspective view of the housing ceiling plate 200U of the development housing 200 of the developing device 20 according to this embodiment. FIG. 14B is an enlarged perspective view enlargedly showing a part of the housing ceiling plate 200U of FIG. 14A. FIGS. 14A and 14B are perspective views of the housing ceiling plate 200U viewed from below (from the side of the developer conveyance path 260).

With reference to FIG. 13, when the toner container 30 is attached to the developing device 20 as described above, the toner discharge port 30P is arranged above the toner supply port 25. The toner flowing into the toner supply port 25 from the toner discharge port 30P flows into the first conveyance path 261 of the developing device 20.

The development housing 200 includes a side wall 200H (FIG. 13). The side wall 200H stands to face the partition plate 265 and extend in the first direction (rightward direction, arrow D1 of FIG. 2), and defines a side part of the first conveyance path 261 on a side opposite to the partition plate 265. Further, the housing ceiling plate 200U includes a projecting portion 200J. The projecting portion 200J is a projection formed by causing a part of the housing ceiling plate 200U to project upward near the toner supply port 25 (see FIG. 6B). Note that a second space P2 (FIG. 13) to be described later is formed inside the projecting portion 200J. Such a projecting portion 200J is integrally shaped when the housing ceiling plate 200U as shown in FIGS. 14A and 14B is formed by resin molding. Specifically, by forming a recess Q by partially recessing a lower surface part of the housing ceiling plate 200U as shown in FIG. 14B, the projecting portion 200J is formed on an opposite side (upper surface side) of the housing ceiling plate 200U. In the recess Q, a ceiling portion 200K is provided to be adjacent to the toner supply port 25. The ceiling portion 200K defines an upper surface part of the second space P2. Further, the projecting portion 200J is integrally formed with the stopper pressing portions 206 and the container shutter fixing portions 207 of FIG. 6B.

Further, with reference to FIG. 14A, the housing ceiling plate 200U includes a roller cover 21AS, a first covering portion 261S, a second covering portion 262S and a partition plate engaging piece 265S. The roller cover 21AS is a curved surface formed on an end part of the housing ceiling plate 200U and has a function of covering a part of the peripheral surface of the developing roller 21A as shown in FIG. 13. Similarly, the first and second covering portions 261S, 262S have a function of respectively covering the first and second conveyance paths 261, 262 from above. Further, the partition plate engaging piece 265S (FIG. 14A) slightly projecting between the first and second covering portions 261S, 262S comes into contact with an upper end part of the partition plate 265 as shown in FIG. 13.

With reference to FIG. 13, an area of the first conveyance path 261 closer to the partition plate 265 than an axial center of the first screw shaft 21B1 (between the first screw shaft 21B1 and the partition plate 265) is defined as a first area. On the other hand, an area of the first conveyance path 261 closer to the side wall 200H than the axial center of the first screw shaft 21B1 (between the first screw shaft 21B1 and the side wall 200H) is defined as a second area. In this embodiment, the first stirring screw 21B rotates (see arrows of FIG. 13) such that an outer peripheral part of the first stirring screw 21B (FIG. 2) moves from top to bottom in the first area (L1) and moves from bottom to top in the second area (L2).

Further, the toner supply port 25 is obliquely open above the second area L2 such that a second end edge 252 extending in the lateral direction (first direction) on the side of the first screw shaft 21B1 is arranged at a higher position than a first end edge 251 extending in the lateral direction on the side of the side wall 200H. This is to allow the toner container 30 to be rotated in the first rotating direction when the toner container 30 is attached. Specifically, as shown in FIG. 14B, the housing ceiling plate 200U defining the container attaching portion 20H (FIG. 6B) for the toner container 30 includes a curved portion 25H curved along a rotation locus of the toner container 30. The toner supply port 25 is open in this curved portion 25H. As a result, the first and second end edges 251, 252 are arranged at positions having different heights as described above.

Figure 15A:
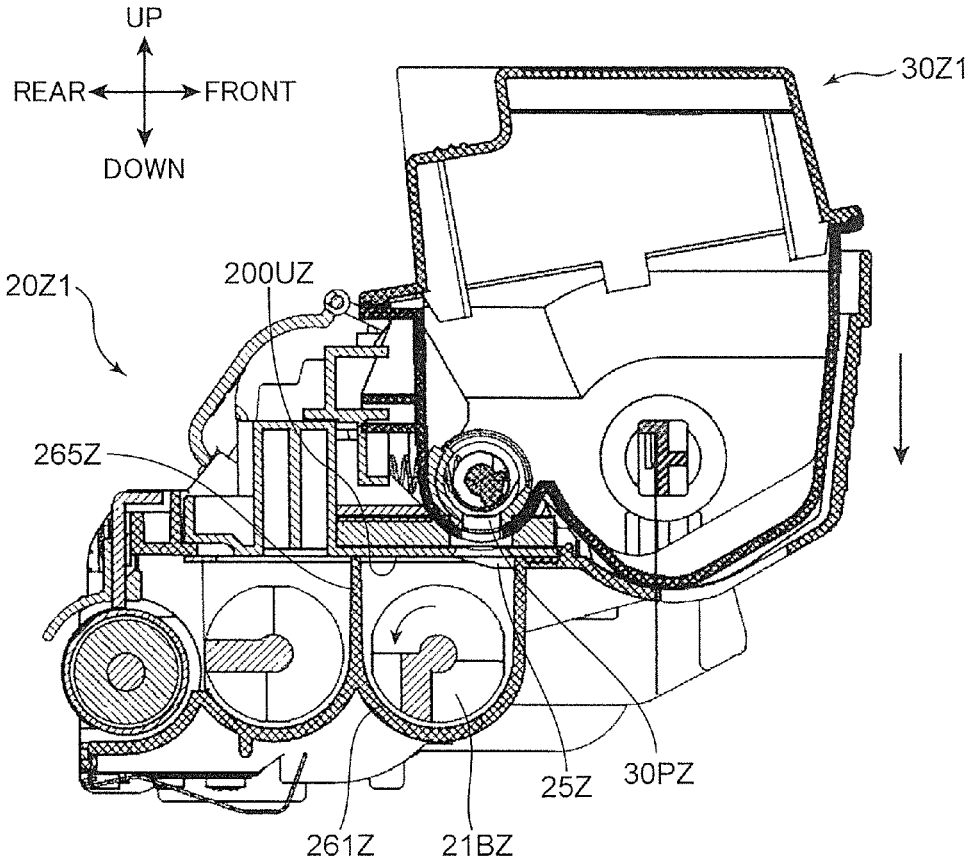
FIG. 15A is a sectional view of conventional developing device and developer storage container.

FIG. 15A is a sectional view of a developing device 20Z1 and a toner container 30Z1 of a conventional developing device. Unlike the toner container 30 according to this embodiment, the toner container 30Z1 is attached to the developing device 20Z1 from top to bottom as shown by an arrow of FIG. 15A. Specifically, since the toner container 30Z1 is not rotated in an attaching process, a toner discharge port 30PZ of the toner container 30Z1 and a toner supply port 25Z of the developing device 20Z1 are respectively open to extend substantially in a horizontal direction. Further, since the toner supply port 30PZ is located right above the toner supply port 25Z, toner is less likely to aggregate between the both. Further, a first conveyance path 261Z provided with a first stirring screw 21BZ is covered by a housing ceiling plate 200UZ extending in the horizontal direction. Also in the developing device 20Z1, a toner supply method of a volume supply type (leveling type) (FIG. 3) as described above is employed and the inflow of replenishing toner is adjusted according to a reservoir of the toner around the toner supply port 25Z.

Figure 15B:
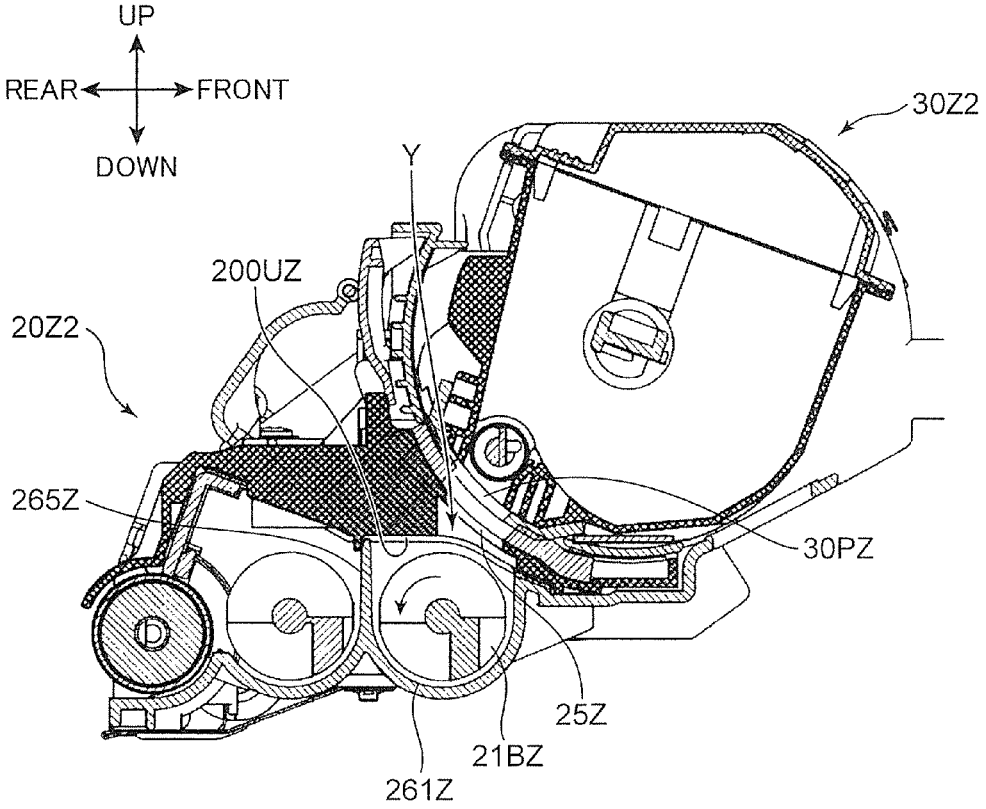
FIG. 15B is a sectional view of another developing device to be compared with the developing device according to the embodiment of the present disclosure and another developer storage container.

FIG. 15B is a sectional view of another developing device 20Z2 to be compared with the developing device 20 according to this embodiment and another toner container 30Z2. In the developing device 20Z2 and the toner container 30Z2, the toner container 30Z2 is rotated in an attaching process similarly to the developing device 20 and the toner container 30 according to this embodiment. Thus, as shown in FIG. 15B, a toner discharge port 30PZ and a toner supply port 25Z are obliquely open. In this case, a space Y having no toner stirring force is formed between the toner supply port 25Z and a first conveyance path 261Z. Further, behind the space Y, the first conveyance path 261Z is covered by a housing ceiling plate 200UZ extending in a horizontal direction. In the case of obliquely arranging the toner supply port 25Z for the structure of the developing device 20Z1 of a conventional volume supply type in this way, there has been a problem that toner is easily aggregated in an igloo-like manner in the space Y. Particularly, such as in the case of successively printing images having a low print density or the like, the toner is easily aggregated in the space Y below the toner supply port 25Z since the toner is not supplied. Further, since a first stirring screw 21BZ is rotated upwardly below the toner supply port 25Z, the toner is pushed toward the toner supply port 25Z and more easily aggregated. As a result, there has been a problem that a supply path is closed by the aggregation of the toner and the replenishing toner does not smoothly flow in. In this case, the density of images to be printed in the printer 100 may be reduced.

To solve the problem described above, a structure as shown in FIG. 13 is employed in this embodiment. Specifically, the development housing 200 includes a first space P1 and the second space P2 when viewed in a cross-section perpendicular to the first screw shaft 21B1 of the first stirring screw 21B and passing through the toner supply port 25. The first space P1 is a space formed above the second area L2 of the first conveyance path 261 and allowing communication between the toner supply port 25 and the first conveyance path 261 in the vertical direction. On the other hand, the second space P2 is a space formed up to a position higher than the partition plate 265 to communicate with the first conveyance path 261 above the first area L of the first conveyance path 261. The second space P2 communicates with the first space P1 in the horizontal direction. Further, as described above, the upper end part of the second space P2 is defined by the ceiling portion 200K.

According to such a configuration, the second space P2 communicating with the first space P1 is provided, whereby a pressure of the toner in the first space P1 is easily released toward the second space P2 (see a white arrow of FIG. 13). Thus, the aggregation of the toner in the first space P1 is suppressed and the replenishing toner can smoothly flow into the first conveyance path 261 from the toner supply port 25.

Further, in this embodiment, the first and second spaces P1, P2 are formed to be larger than the toner supply port 25 in the lateral direction as shown in FIG. 14B. Specifically, both end parts of the first and second spaces P1, P2 in the lateral direction are located outwardly of both end parts of the toner supply port 25. Since the first space P1 is formed to be larger than the toner supply port 25 in the lateral direction, the reservoir 29 (FIG. 3) of the toner can be formed to cover the periphery of the toner supply port 25. Thus, the supply of the replenishing toner and the stop of the supply can be stably realized. Further, since the second space P2 is formed to be larger than the toner supply port 25 in the lateral direction, the toner flowing in from the toner supply port 25 can enter sides upstream and downstream of the toner supply port 25 in the first conveying direction. Thus, even if the pressure of the toner in the first space P1 increases, this pressure of the toner can be further released.

On the other hand, if the second space P2 (FIG. 13) is formed as described above, new replenishing toner (replenishing developer) swiftly flows into the second space P2 from the first space P1 in some cases when the toner container 30 is exchanged with a new one. If the upper surface part of the second space P2 is set at an extreme high position, a large amount of the replenishing toner is accumulated in the second space P2. Thereafter, if this replenishing toner is supplied to the developing roller 21 without being sufficiently stirred along an upper surface part (draft surface) of a developer layer in the developer conveyance path 260 upon receiving a conveying force of the first stirring screw 21B, toner fogging (developer fogging) due to the replenishing toner occurs.

As just described, the housing ceiling plate 200 includes the ceiling portion 200K (FIG. 14B) in this embodiment to solve an inherent problem caused by forming the second space P2. The ceiling portion 200K defines the upper surface part of the second space P2. Further, the ceiling portion 200K is configured by end edges (lower end parts) of a plurality of ribs 50 arranged adjacent to each other. Particularly, in this embodiment, the ribs 50 include a plurality of first ribs 51 extending in a direction perpendicular to the first direction (toner conveying direction) and a second rib 52 extending in the first direction to connect the plurality of first ribs 51. In other words, the plurality of ribs 50 are arranged in a lattice manner. Note that, in this embodiment, the plurality of ribs 50 are integrally formed when the housing ceiling plate 200U is formed by resin molding.

The ceiling portion 200K formed by the plurality of such ribs 50 is arranged above the second end edge 252 of the toner supply port 25. Note that, in this embodiment, the ceiling portion 200*k* is arranged slightly above the second end edge 252 (slightly above along the peripheral surface of the curved portion 25H) as shown in FIG. 14B. The ceiling portion 200K partially restricts a movement of the replenishing toner in the first direction by coming into contact with the replenishing toner flowing into the second space P2 from the first space P1 from above. In other words, when a predetermined amount of the replenishing toner flows into the second space P2 from the first space P1, the ceiling portion 200K presses an aggregate of the replenishing toner from above. As a result, it is suppressed that the replenishing toner newly flowed in is supplied to the developing roller 21 along the upper surface part of the developer layer in the developer conveyance path 260 without being sufficiently stirred.

Particularly, since the replenishing toner enters spaces between the plurality of ribs 50 arranged in a lattice matter to be trapped in this embodiment, the movement of the replenishing toner can be partially stopped. Thus, toner fogging due to the replenishing toner can be stably suppressed.

Although the developing device 20 according to the embodiment of the present disclosure and the printer 100 provided with the same are described above, the present disclosure is not limited to this. For example, the following modifications can be employed.

(1) Although a monochrome printer is described as the printer 100 in the above embodiment, the present disclosure is not limited to this. The printer 100 may be a tandem color printer or the like. Further, the image forming apparatus according to the present disclosure may be another structure such as a facsimile machine and a complex machine.

(2) Further, although the conveying ability suppressing portion 28 of the first stirring screw 21B is a plate-like member arranged between the adjacent sections of the first spiral blade 21B2 in the above embodiment, the present disclosure is not limited to this. The conveying ability suppressing portion may be shaped by a partially missing part of the first spiral blade 21B2. Also in this case, the reservoir 29 of the toner can be stably formed.

(3) Further, although the plurality of ribs 50 (FIG. 14B) constituting the ceiling portion 200K include the first ribs 51 and the second rib 52 in the above embodiment, the present disclosure is not limited to this. The plurality of ribs 50 may be composed only of a plurality of first ribs 51 or a plurality of second ribs 52 arranged adjacent to each other. Further, by fixing ribs formed of separate members to the underside (lower surface) of the housing ceiling plate 200U, the ceiling plate of the present disclosure may be configured as a whole.

The invention claimed is:

1. A developing device, comprising:

a housing including a ceiling plate;

a developing roller including a first shaft portion, supported rotatably on the housing with the first shaft portion as a rotary shaft and configured to supply developer to an image carrier, on a surface of which an electrostatic latent image is to be formed;

a developer conveyance path including a first conveyance path, in which the developer is conveyed in a first conveying direction along an axial direction of the first shaft portion, and a second conveyance path, which is arranged between the developing roller and the first conveyance path and in which the developer is conveyed in a second conveying direction opposite to the first conveying direction, having an upper part covered by the ceiling plate and configured to convey the developer in a circulating manner;

a partition plate arranged in the housing and configured to partition between the first and second conveyance paths along the axial direction such that the first and second conveyance paths communicate at both end parts;

a developer supply port open in the ceiling plate above the first conveyance path and configured such that replenishing developer discharged from a predetermined developer storage container flows thereinto;

a developer conveying member arranged in the first conveyance path, including a second shaft portion parallel to the first shaft portion and configured to convey the developer in the first conveying direction to pass below the developer supply port by being rotated with the second shaft portion as a rotary shaft; and a conveying ability suppressing portion configured to partially suppress a conveying ability of the developer of the developer conveying member on a side downstream of the developer supply port in the first conveying direction and form a reservoir of the developer in an area of the first conveyance path facing the developer supply port, wherein:

the developer in the reservoir seals the developer supply port from below when the amount of the developer in the developer conveyance path increases, whereas a clearance is formed between the reservoir and the developer supply port, whereby the replenishing developer flows into the first conveyance path from the developer supply port, when the amount of the developer in the developer conveyance path decreases;

the housing includes a side wall standing to face the partition plate and extend in the first direction and defining the first conveyance path on a side opposite to the partition plate;

the developer conveying member rotates such that an outer peripheral part thereof moves from top to bottom in a first area between the second shaft portion and the partition plate and moves from bottom to top in a second area between the second shaft portion and the side wall;

the developer supply port is obliquely open above the second area such that a second end edge extending in the first direction on the second shaft portion side is arranged at a higher position than a first end edge extending in the first direction on the side wall side;

the housing includes a first space formed above the second area of the first conveyance path and allowing communication between the developer supply port and the first conveyance path in a vertical direction and a second space formed up to a position higher than the partition plate to communicate with the first conveyance path above the first area of the first conveyance path and communicating with the first space in a horizontal direction when viewed in a cross-section perpendicular to the second shaft and passing through the developer supply port;

the ceiling plate includes a ceiling portion defining an upper surface part of the second space;

the ceiling portion is configured by end edges of a plurality of ribs arranged adjacent to each other; and the ceiling portion is arranged above the second end edge and partially restricts a movement of the replenishing developer in the first direction by coming into contact with the replenishing developer flowing into the second space from the first space.

2. A developing device according to claim 1, wherein the plurality of ribs are arranged in a lattice manner.

3. A developing device according to claim 1, wherein the first and second spaces are formed to be larger than the developer supply port in the first direction.

4. A developing device according to claim 1, wherein:

the developer conveying member includes a spiral blade arranged around the second shaft portion; and the conveying ability suppressing portion is shaped by a partially missing part of the spiral blade.

5. A developing device according to claim 1, wherein:

the developer conveying member includes a spiral blade arranged around the second shaft portion; and the conveying ability suppressing portion is a plate-like member arranged between sections of the spiral blade adjacent in an axial direction of the second shaft portion.

6. An image forming apparatus, comprising:

an image carrier configured such that an electrostatic latent image is to be formed on a surface and configured to carry a developer image;

a developing device according to claim 1 configured to supply the developer to the image carrier;

the developer storage container configured to store the replenishing developer to be supplied to the developing device inside; and a transfer unit configured to transfer the developer image from the image carrier to a sheet.

7. An image forming apparatus according to claim 6, wherein:

the housing of the developing device includes an attaching portion to which the developer storage container is to be attached and is defined by the ceiling plate;

the developer storage container includes a developer discharge port from which the replenishing developer is to be discharged;

the developer storage container is rotated about an axial center extending in parallel to the first direction in the attaching portion after being attached to the attaching portion along an attaching direction perpendicular to the first direction, whereby the developer discharge port is arranged above the developer supply port and communicates with the developer supply port; and the ceiling plate includes a curved portion curved along a rotation locus of the developer storage container about the axial center, and the developer supply port is open in the curved portion, whereby the second end edge of the developer supply port is arranged at a position higher than the first end edge.

8. An image forming apparatus according to claim 7, wherein:

the developer storage container includes a shutter capable of sealing and opening the developer discharge port;

the ceiling plate of the housing of the developing device includes a projecting portion projecting upward and having the second space inside; and the ceiling plate further includes a shutter restricting portion arranged in an upper end part of the projecting portion and configured to be engaged with the shutter when the developer storage container is attached to the attaching portion along the attaching direction and allow the developer discharge port separated from the shutter to communicate with the developer supply port by fixing the shutter when the developer storage container is rotated about the axial center.

* * * * *